US007935230B2

(12) United States Patent
Woodruff et al.

(10) Patent No.: US 7,935,230 B2
(45) **Date of Patent: *May 3, 2011**

(54) ELECTRO-CHEMICAL PROCESSOR

(75) Inventors: Daniel J. Woodruff, Kalispell, MT (US); Paul R. McHugh, Kalispell, MT (US); Gregory J. Wilson, Kalispell, MT (US); Kyle M. Hanson, Kalispell, MT (US); Nigel Stewart, Burwell (GB); Erik Lund, Burien, WA (US); Steven L. Peace, Whitefish, MT (US)

(73) Assignee: Semitool, Inc., Kalispell, MT (US)

( * ) Notice: Subject to any disclaimer, the term of this patent is extended or adjusted under 35 U.S.C. 154(b) by 1054 days.

This patent is subject to a terminal disclaimer.

(21) Appl. No.: 11/608,151

(22) Filed: Dec. 7, 2006

(65) Prior Publication Data

US 2008/0003781 A1 Jan. 3, 2008

Related U.S. Application Data

(63) Continuation-in-part of application No. 11/457,192, filed on Jul. 13, 2006, and a continuation-in-part of application No. 11/467,232, filed on Aug. 25, 2006, and a continuation-in-part of application No. 11/480,313, filed on Jun. 29, 2006, now abandoned.

(51) Int. Cl.
*C25F 7/00* (2006.01)

(52) U.S. Cl. ..... 204/269; 204/267; 205/640; 205/686

(58) Field of Classification Search ..... 204/267, 204/269; 205/640, 686
See application file for complete search history.

(56) References Cited

U.S. PATENT DOCUMENTS

| | | | | |
|---|---|---|---|---|
| 5,335,012 | A | 8/1994 | Lisec | |
| 5,376,241 | A * | 12/1994 | Shor et al. | 205/645 |
| 6,252,203 | B1 * | 6/2001 | Zapata et al. | 219/405 |
| 6,585,875 | B1 * | 7/2003 | Ryabkov | 205/87 |
| 6,726,815 | B1 * | 4/2004 | Artmann et al. | 204/267 |
| 7,285,195 | B2 * | 10/2007 | Herchen et al. | 204/297.01 |
| 2002/0130049 | A1 * | 9/2002 | Chen et al. | 205/640 |
| 2003/0132118 | A1 | 7/2003 | Kovarsky | |
| 2003/0205461 | A1 * | 11/2003 | Olgado | 204/198 |
| 2004/0134787 | A1 | 7/2004 | Pedersen et al. | |

OTHER PUBLICATIONS

Lehmann, Volker, "Electrochemistry of Silicon," Dec. 31, 2002, pp. 5-22, Wiley-VCH Verlag GmvH, Weinheim Germany.

United States Patent and Trademark Office, International Search Report and Written Opinion for PCT/US07/71474, mailed Aug. 6, 2008.

* cited by examiner

*Primary Examiner* — Alexa D. Neckel
*Assistant Examiner* — Nicolas A. Smith
(74) *Attorney, Agent, or Firm* — Kenneth H. Ohriner; Perkins Coie LLP

(57) ABSTRACT

A processor for making porous silicon or processing other substrates has first and second chamber assemblies. The first and second chamber assemblies include first and second seals for sealing against a wafer, and first and second electrodes, respectively. The first and/or second seal is moveable towards and away from a wafer in the processor, to move between a wafer load/unload position, and a wafer process position. The first electrode may move along with the first seal, and the second electrode may move along with the second seal. A light source shines light onto the first side of the wafer. The processor may be pivotable from a substantially horizontal orientation, for loading and unloading a wafer, to a substantially vertical orientation, for processing a wafer.

47 Claims, 27 Drawing Sheets

FIG. 33
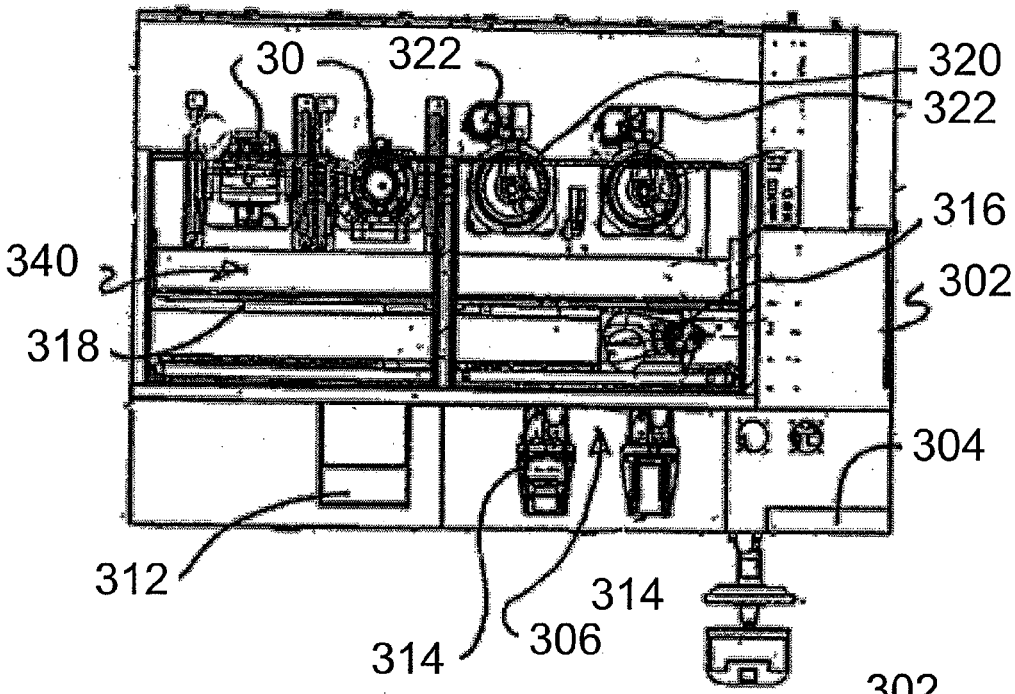
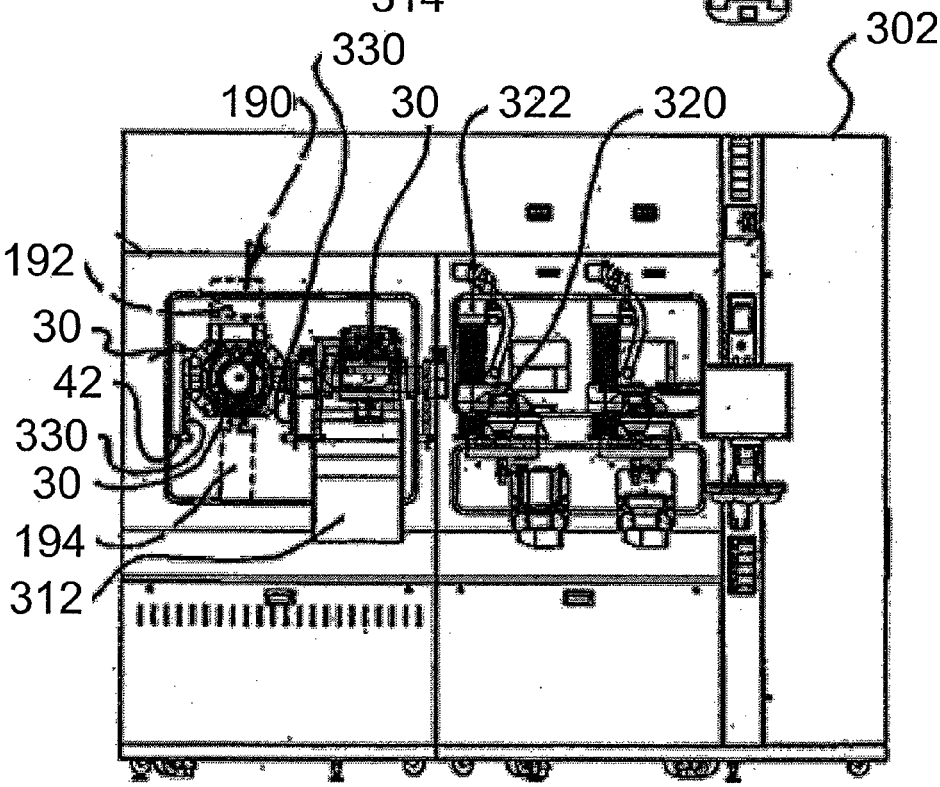
FIG. 34

ELECTRO-CHEMICAL PROCESSOR

CROSS-REFERENCE TO RELATED APPLICATIONS

This application is a continuation-in-part of 1) U.S. patent application Ser. No. 11/457,192, filed Jul. 13, 2006, 2) U.S. patent application Ser. No. 11/467,232, filed Aug. 25, 2006, and 3) U.S. patent application Ser. No. 11/480,313, filed Jun. 29, 2006, now abandoned. These applications are incorporated herein by reference.

BACKGROUND

Silicon is the basic building block material of most micro-electronic devices. Other micro-scale devices such as micro-electro-mechanical devices (MEMs), and micro-optic devices, are also generally made of silicon. These devices are used in virtually all modern electronic products. The raw silicon material used in making these types of microscopic devices is ordinarily provided in the form of thin flat polished wafers.

Porous silicon is a form of silicon having tiny openings or pores. These pores can absorb and emit light. This allows porous silicon devices to interact with light and electronic devices in many useful ways. Porous silicon also has a very large surface area and acts as a strong adsorbent. These properties make porous silicon useful in mass spectrometry, micro-fluidic devices, sensors, fuel cell electrodes, optical, chemical and mechanical filters, biochips and biosensors, fuses for airbags, and various other products.

The porous silicon material itself may also be used as a porous and/or solvable substrate, for example in diagnostic or therapeutic products. Accordingly, porous silicon is increasingly becoming an important material in a wide range of products and technologies.

Porous silicon is generally manufactured in an electro-chemical etching process. A silicon wafer is typically exposed to an electrolyte including concentrated hydrofluoric acid (HF). The electrolyte on one side of the wafer is sealed off from the electrolyte on the other side of the wafer. Electrical current is passed through the electrolyte on each side, making one side the cathode and the other side the anode. The silicon wafer may optionally be exposed to light during this process. The process etches pores in the wafer. The pores are microscopic. A 150 mm diameter wafer may have more than 1 billion pores after electro-chemical processing. Porous silicon may be formed by starting with p-type or n-type silicon, and then forming porous silicon in an electro-chemical process.

Although various types of porous silicon machines or processors have been used, disadvantages remain in performance, reliability, speed, and other design parameters. HF is highly corrosive and toxic. Accordingly, it must be carefully contained within the processor. Since HF will react with virtually all metals, metals cannot effectively be used in areas of the processor that may come into contact with HF. Moreover, even the smallest of amount of interaction between the HF in the electrolyte and metal can contaminate the wafer. The uniform processing required to consistently produce high quality porous silicon also requires uniform electrical current flow through the electrolyte. Achieving uniform current flow is affected by the design of the processor and may be challenging to achieve.

Some porous silicon processors require illumination of the wafer, creating still further design challenges. In these processors, highly uniform and very bright lighting is desired to achieve high quality porous silicon. Uniform current flow is also a significant factor. However, the size, shape and location of an anode electrode designed for uniform current flow may interfere with the lighting, especially in a compact processor design. Accordingly, achieving both uniform lighting and uniform current flow in a porous silicon wafer processor may be difficult.

Existing illuminated porous silicon processors generally use large, high power tungsten halogen lamps, or similar types of lamps. Typically, these lamps are positioned relatively far from the wafer. As a result, they tend to illuminate not only the wafer, but also a large area around the wafer. Consequently, they may consume excessive electrical power and generate excessive heat. Excessive heat may be disadvantageous, as it can affect the process liquid, which often includes a solvent such as isopropyl alcohol. Powering the lamps using the low voltages generally associate with solvent containing process liquids can create other design problems as well.

Existing processors have offered only varying results in the face of these engineering design challenges. In view of these factors, improved methods, processors and systems for making porous silicon are needed.

BRIEF STATEMENT OF THE INVENTION

A novel processor has now been invented providing various improvements in making porous silicon or in similar electro-chemical processing. This new processor provides highly uniform processing. Potential for contamination of wafers before, during, and after processing is significantly reduced. Potential for corrosion of processor components is similarly largely avoided, offering long term reliability and performance, and reduced maintenance requirements. The processor is also adaptable for use in an automated processing system, providing relatively rapid processing.

In one aspect, the processor has a first seal in housing, and a first electrode in the housing associated with the first seal. A second seal in the housing may be moved relative to the first seal. A second electrode is associated with the second seal. The housing may be set up to pivot from a horizontal position to a vertical position. This allows a wafer to be loaded and unloaded in a horizontal position, and processed in a substantially vertical position.

In another aspect, one or more lamps may be positioned to shine light through an open central area of the first electrode, towards a workpiece between the first and second seals. This design provides a processor offering very good performance in a compact space. In another aspect, seal rinsing capability and control of electrical current and electrolyte makeup may be used to provide more uniform wafer-to-wafer processing.

The invention resides as well in methods for electro-chemical processing, and in sub-combinations of the elements and steps described.

BRIEF DESCRIPTION OF THE DRAWINGS

In the drawings, wherein the same reference number indicates the same element, in each of the views:

FIG. 33 is a top view of the system shown in FIG. 32.

FIG. 34 is a front view of the system shown in FIG. 32.

DETAILED DESCRIPTION OF THE DRAWINGS

Figure 1:
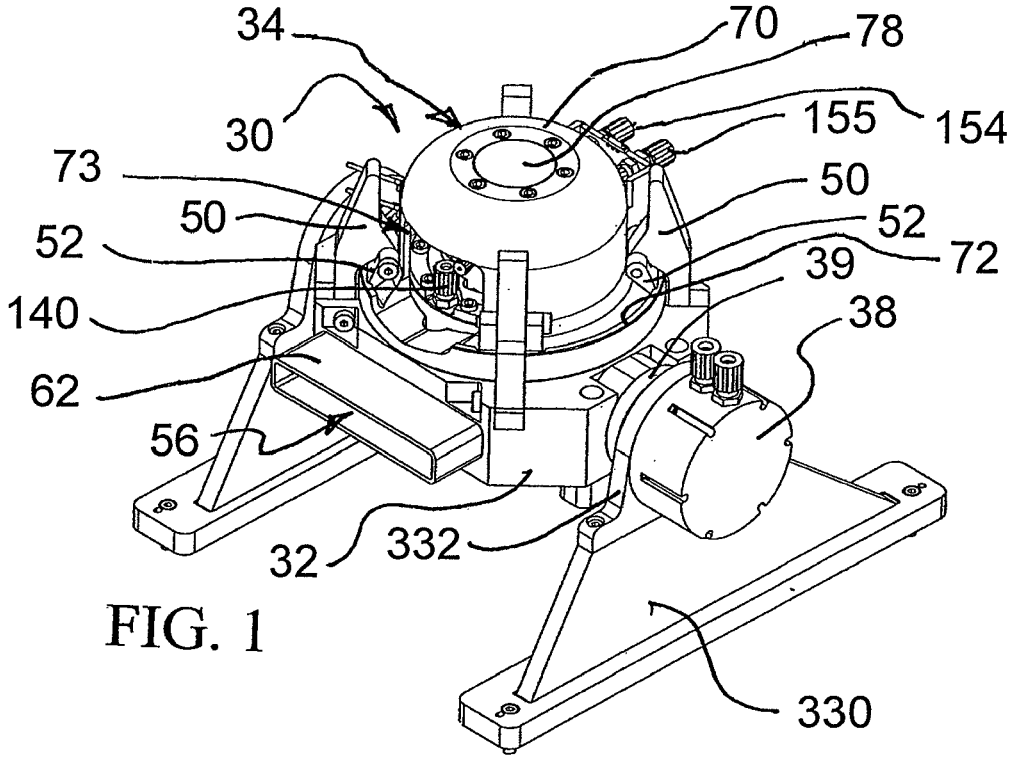
FIG. 1 is a top and front perspective view of a porous silicon processor.
Figure 2:
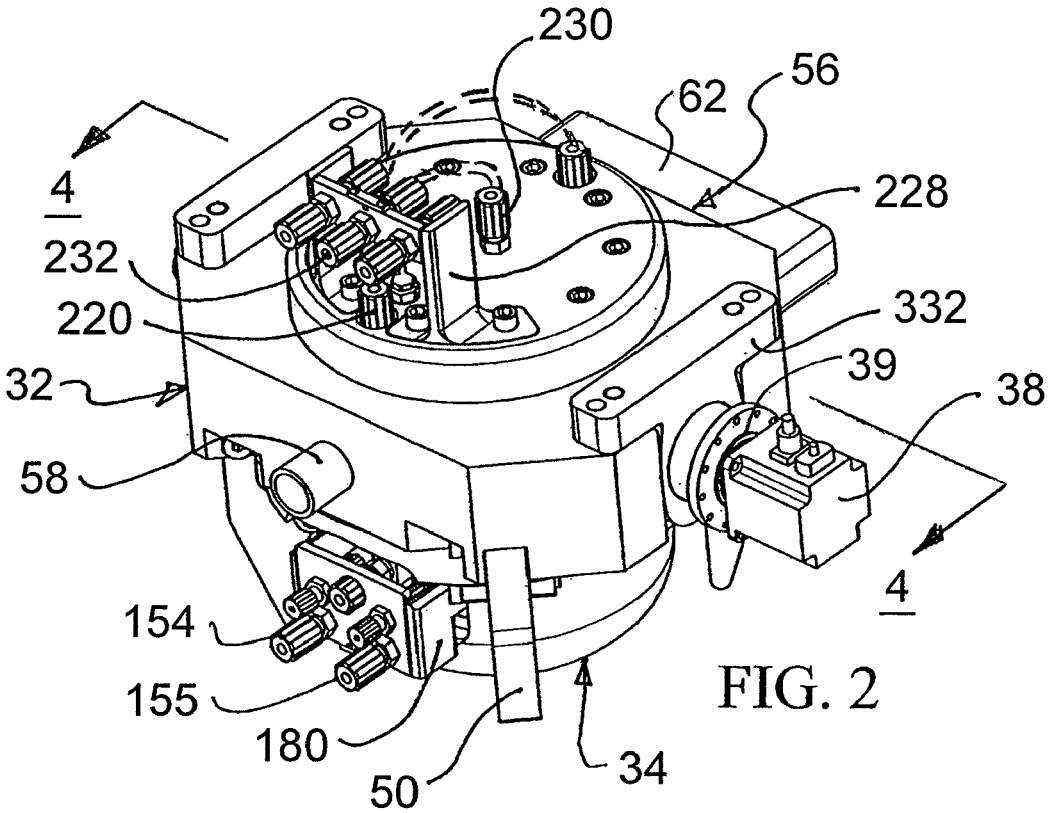
FIG. 2 is a bottom and back perspective view of the processor shown in FIG. 1 with the mounting plates omitted for purpose of illustration.
Figure 3:
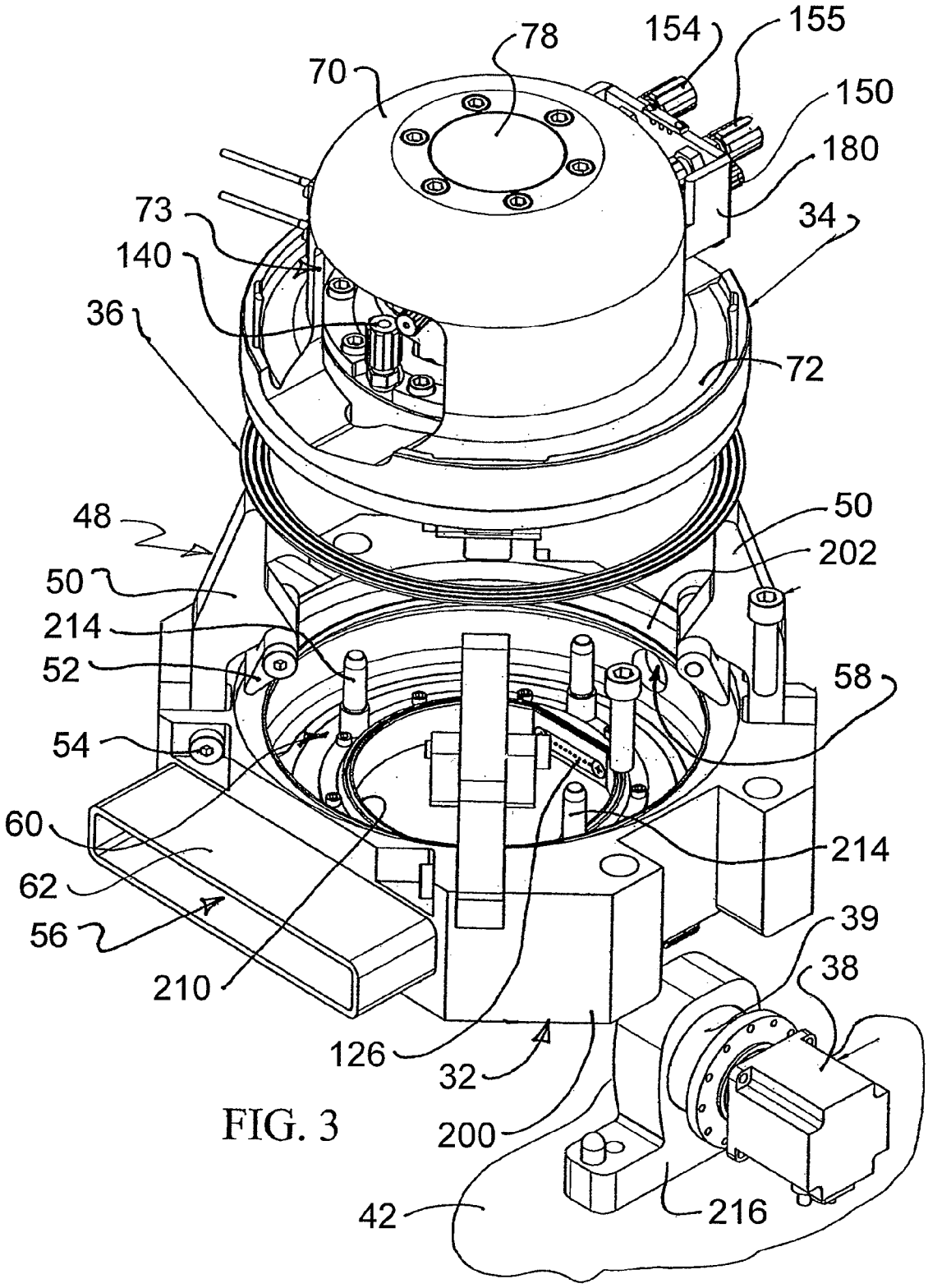
FIG. 3 is an exploded top and front perspective view of the processor shown in FIGS. 1 and 2.

Turning now in detail to the drawings, as shown in FIGS. 1-3, a first processor assembly or head 34 is attached to a second processor assembly or base 32, to form an electro-chemical processor 30. A motor or other actuator, such as a rotate motor 38, can move the processor 30 from the horizontal position shown in FIGS. 1-3, usually about one-quarter turn, into a vertical position.

A retainer generally designated 48 is provided on the head and/or the base for holding them together. Various forms of retainer 48 may be used. In a basic form, the retainer 48 may simply be bolts or other fasteners holding the head onto the base. FIGS. 1-4 show another form of retainer 48 having four spaced apart cam handles 50 pivotably attached to the base 32 via pivot bolts 54, and with a cam latch 52 pivotably attached onto each cam handle 50. When engaged or locked, the cam handles 50 securely seal the head 34 to the base 32, as shown in FIG. 1. The cam handles 50 may be quickly released (by pulling radially outwardly), to allow the head 34 to be separated from the base 32, for system set up, inspection, or maintenance.

Figure 5:
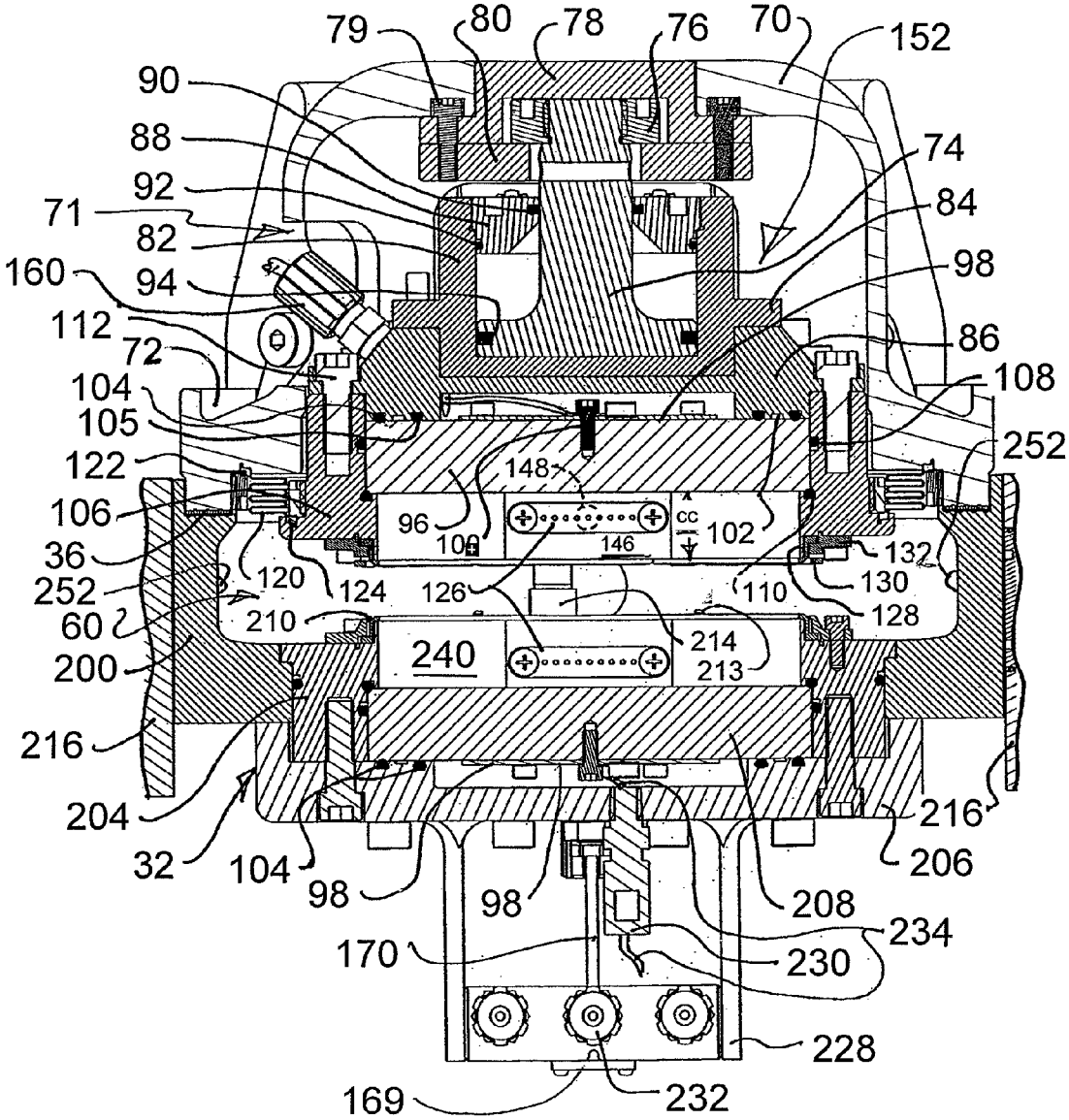
FIG. 5 is a partial section view taken along line 5-5 of FIG. 4.

Turning in addition now to FIG. 5, when secured together, the head 34 and the base 32 may form a containment chamber 60, with process chambers 146 and 240 within the containment chamber. Referring momentarily again to FIGS. 1-3, a load/unload workpiece opening or slot 56 extends through the base 32, to allow a wafer to be moved through the containment chamber 60 to the process chambers. A containment drain or opening and gas/vapor exhaust 58 may be provided in the base 32, generally opposite from the load slot 56. A frame 62 may surround the load slot 56 at the front of the processor 30.

For electro-chemical processing, the processor 30 is provided with two electrodes and two process chamber seals. At least one process chamber seal is moveable. An electrode may move with the moveable process seal. The moveable seal may be in the head 34 or in the base 32. The other electrode and process chamber seal, may be fixed or moving, and typically are fixed in place within the processor 30. The drawings show an example of the processor 30 where the moving electrode and seal is in a head, and a fixed electrode and seal is in a base, positioned vertically on top of the base. However, these positions may be reversed, as they are not essential to the invention. Except for the two electrodes and the two process chamber seals, the other specific components described below, including those forming the containment chamber 60, are not necessarily essential and may be omitted, or substituted out in place of an equivalent functional element.

The specific mechanism or force selected to move the moveable seal is also not essential. This movement may be provided by hydraulic, pneumatic, electric, gas or steam pressure, or mechanical forces. In the design shown, hydraulic force is used, with water as the hydraulic fluid. In this example of a hydraulically driven processor, as shown in FIG. 5, a piston cap 78 is attached to the head cover 70. A piston 74 is fixed in position relative to the cover 70 by a piston nut 76 and a piston plate 80. A cylinder 82 is supported around the piston 74, with the lower end of the piston 74 sealed against the interior cylinder walls by a piston seal 94. A piston ring 88 is attached to the upper end of the cylinder 82. An inner piston ring seal 90 seals the piston ring 88 against the piston 74. An outer piston ring seal 92 seals the piston ring 88 against the cylinder 82. For clarity of illustration, fluid and electrical lines and cables are generally omitted from the drawings.

A cylinder ring 86 is attached to an annular flange 84 of the cylinder 82. An upper or first electrode ring 106 is in turn attached to an annular flange of the cylinder ring 86 via cap screws 112. An upper or first electrode 96 (in this case, the cathode) is held in place between the electrode ring 106 and the cylinder ring 86. The electrode 96 is sealed against the electrode ring 106 by first and second seals 110 and 108 at the front surface and cylindrical side of the electrode 96. A third seal 104 and a fourth seal 105 seal the back surface of the electrode 96 against the cylinder ring 86. An annular groove 102 is positioned between the third seal 104 and the fourth seal 105 for improved leak detection, as described below. An electrode lead or wire 95 runs through a electrical fitting 155 on the upper fittings plate 180 and through a fitting 160 on the cylinder ring 86 and is attached to a buss plate 98 via a cap screw 100. Metal cap screws may be used to secure the buss plate onto the back surface of the electrode 96. Typically, multiple cap screws are used to secure the buss plate to the electrode, in a geometric pattern, since the number and location of the screws may affect the uniformity of current flow through the electrode, and ultimately affect current uniformity at the wafer.

Figure 15:
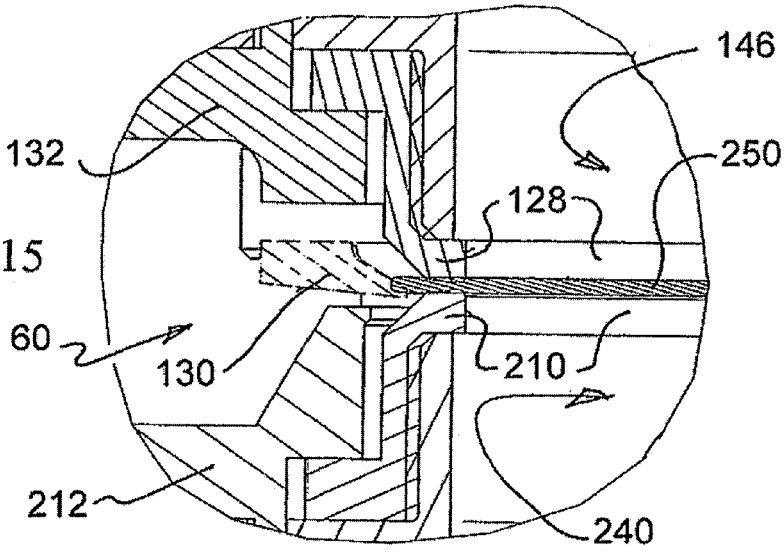
FIG. 15 is an enlarged section view of the seals and ejector tab shown in FIG. 5.
Figure 16:
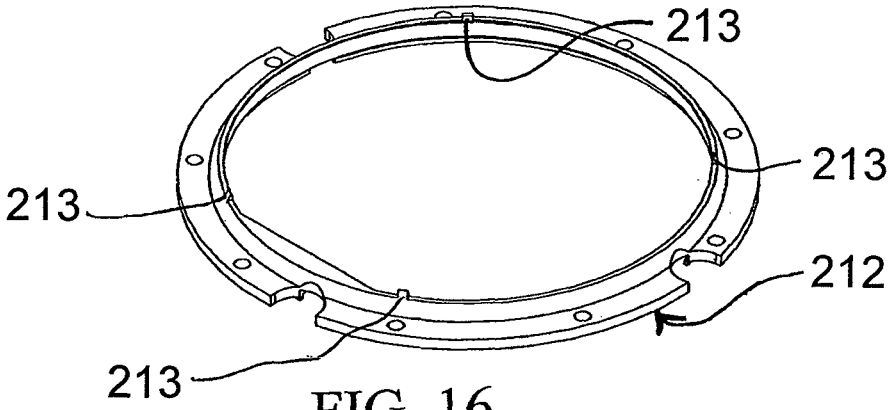
FIG. 16 is a perspective view of the lower seal retainer shown in FIGS. 13-15.

Referring to FIGS. 5 and 15, a head seal 128 is attached to the bottom surface of the electrode ring 106 via an upper seal clamp ring 132. The cylindrical open space shown in FIG. 5 as CC between the electrode 96 and the plane of the head seal forms an upper process chamber 146 when the seal 128 is in contact with a wafer. The upper end of a bellows 120 is attached to the underside of an annular cam ring 72 on the cover 70 by an upper bellows retainer ring 122. The lower end of the bellows 120 is attached to a lip on the electrode ring 106 via a lower bellows retainer ring 124. As a result, upon actuation of the cylinder 82, the entire moveable electrode assembly 152, including the piston ring 88, cylinder 82, cylinder ring 86, electrode 96, electrode ring 106, and the seal 128 can move vertically relative to the cover 70, as well as to the base 32, with the bellows 120 maintaining a seal between the electrode assembly 152 and the base 32.

Figure 7:
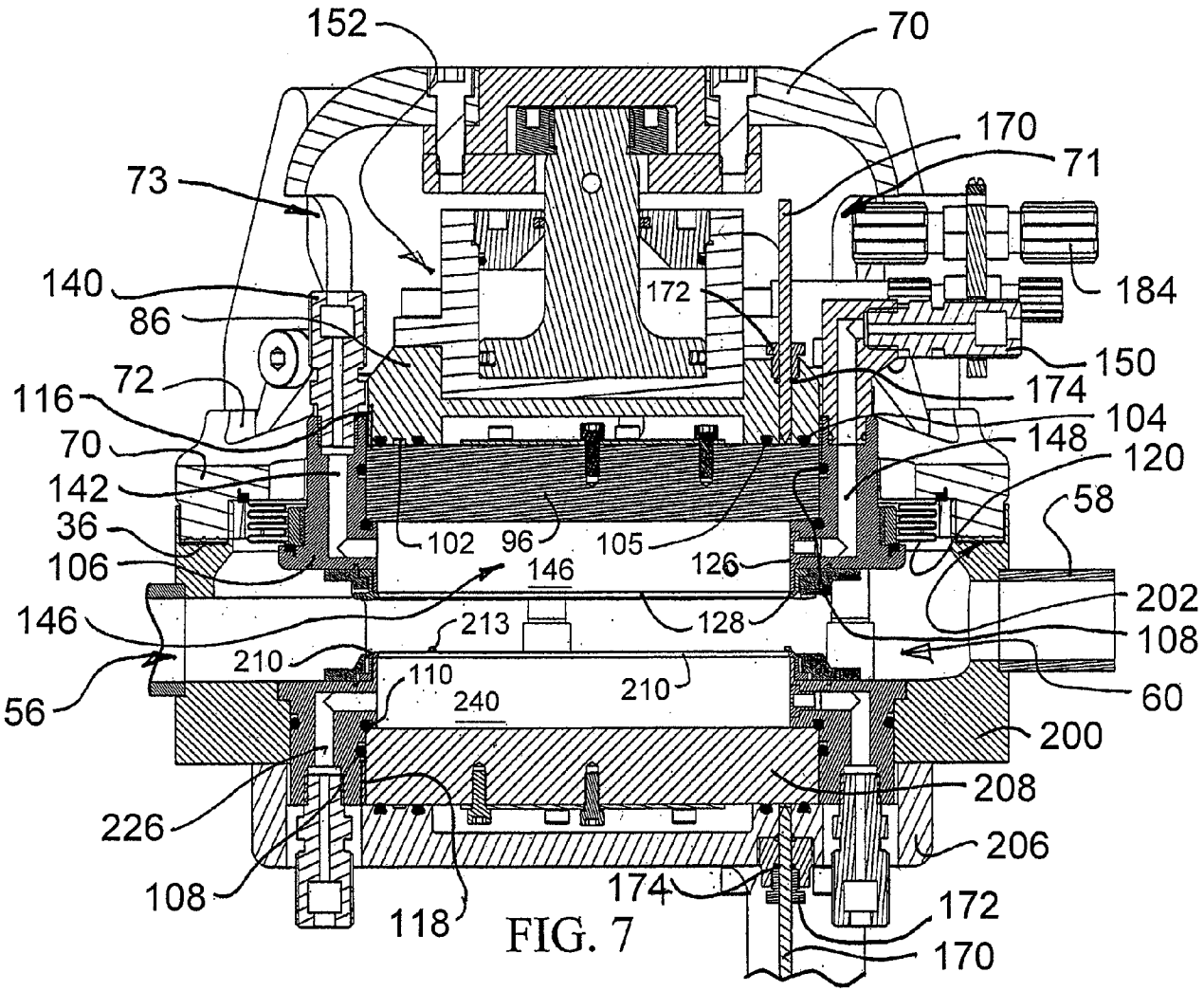
FIG. 7 is a partial section view taken along line 7-7 of FIG. 4.
Figure 10:
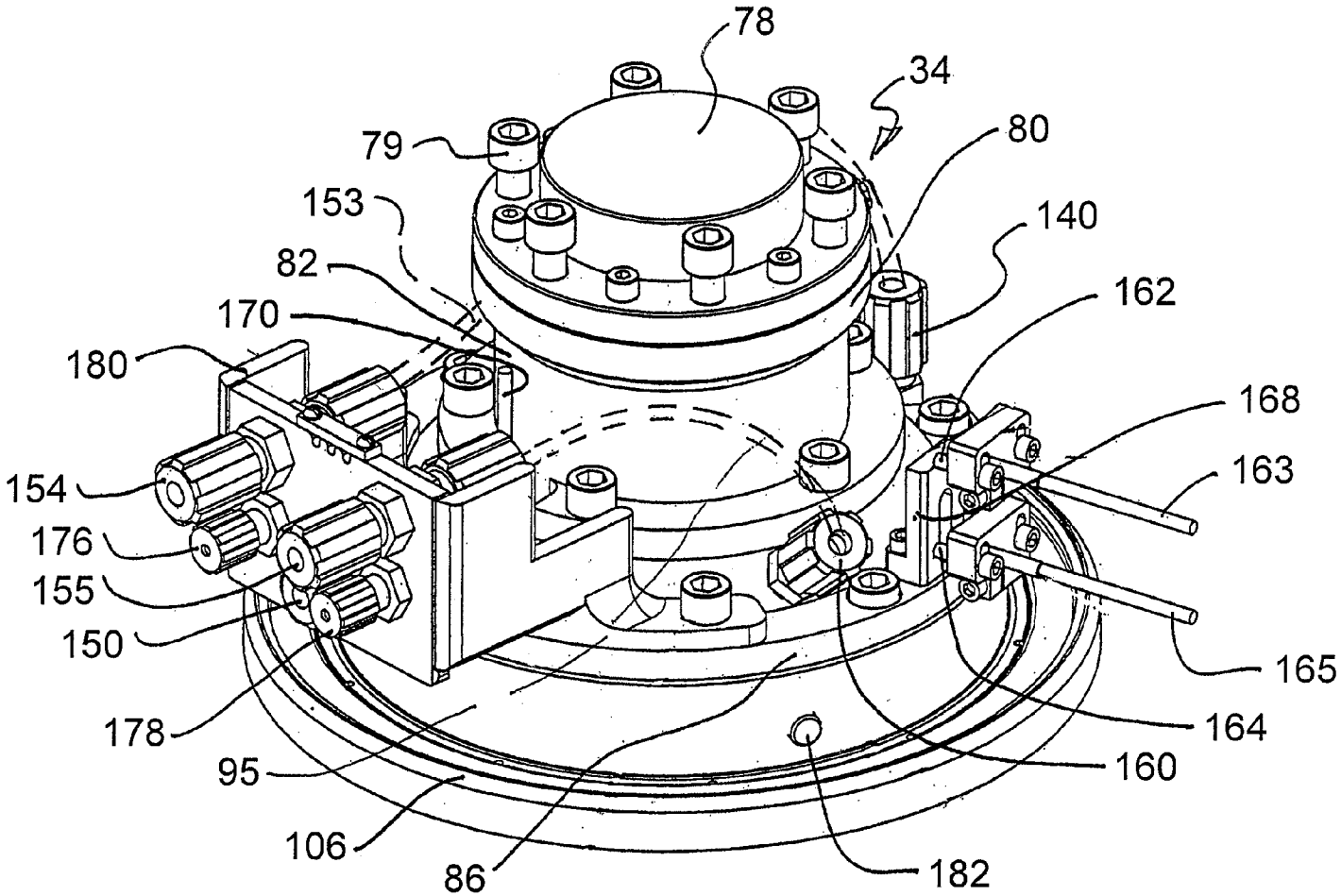
FIG. 10 is a top and front perspective view of the head shown in FIG. 9 with the head cover removed.

Referring now also to FIGS. 7 and 10, an electrolyte liquid port or outlet 148 connects from an outlet or recirculation fitting 150 to a duct 148 in the electrode ring 106 that opens into the chamber 146. An electrolyte liquid inlet 142, which may be located opposite from the outlet 148, leads to an electrolyte recirculation or inlet fitting 140, with an connection line 153, shown in dotted lines in FIG. 10, connecting the fitting 140 to a fitting 154 on the upper fitting bracket 180. A diffuser plate 126 having multiple small openings is positioned over the inlet 148 in the upper process chamber 146. Windows or openings 71 and 73 are provided in the side walls of the cover 70, to provide clearance for the up and down vertical movement of the fluid and electrical fittings, e.g., the electrical connector 160 and the liquid process chemical recirculation or outlet fitting 150, as the electrode assembly 152 moves up and down. Referring still to FIG. 7, an optical liquid detector 170 extends through a clamp nut 172 and seal 174 in the cylinder ring 86, with the tip of the detector 170 positioned within the groove 102. The detector 170 can be connected to a processor controller (such as the controller 304 described below) via fiber optic lines passing through a strain relief feature on the head. The fluid and electrical or optical lines connecting to the head may be made through adapters on connectors on the upper fitting bracket to provide strain relief as the processor 30 moves between horizontal and vertical positions.

As also shown in FIG. 7, an upper seal vent 116 is provided between the second seal 108 and the third seal 104. The vent 116 is designed to reduce wicking of electrolyte inwardly between the back surface of the electrode 96 and the bottom surface of the cylinder ring 86. Similarly, a lower seal vent 118 is located to reduce wicking of electrolyte between the back surface of the lower or second electrode 208 and the electrode cover 206, in the event of a leak of electrolyte past the first seal 110 and the second seal 108.

Figure 8:
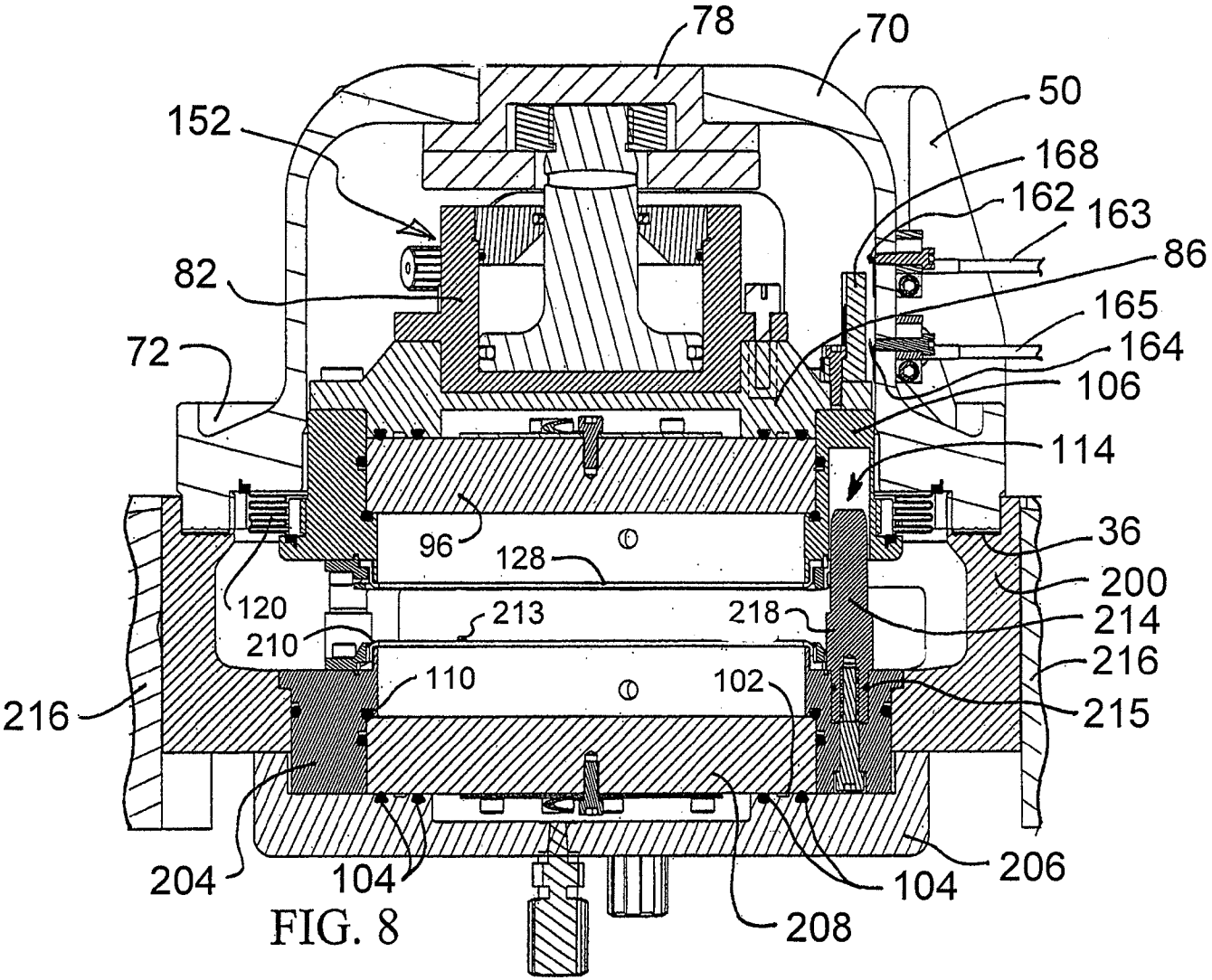
FIG. 8 is a partial section view taken along line 8-8 of FIG. 4.

Turning to FIG. 8, an optical flag plate 168 extends up from the cylinder ring 86. Upper and lower optical sensors 162 and 164 attached to the cover 70, and are also connected via the fiber optic leads 163 and 165 to the processor controller. Strain relief fittings such as the clamp plate 169 shown in FIG. 5, are typically provided on these leads, so that they may better accommodate the movement of the processor. The sensors 162 and 164 detect the position of the flag plate 168, which corresponds to the position of the moveable electrode assembly 152 relative to the base 32. Also as shown in FIG. 8, the electrode ring 106 includes bores 114. Guide pins 214 in the base 32 extend into the bores 114, to maintain the moveable electrode assembly 152 in alignment with the base 32.

Figure 9:
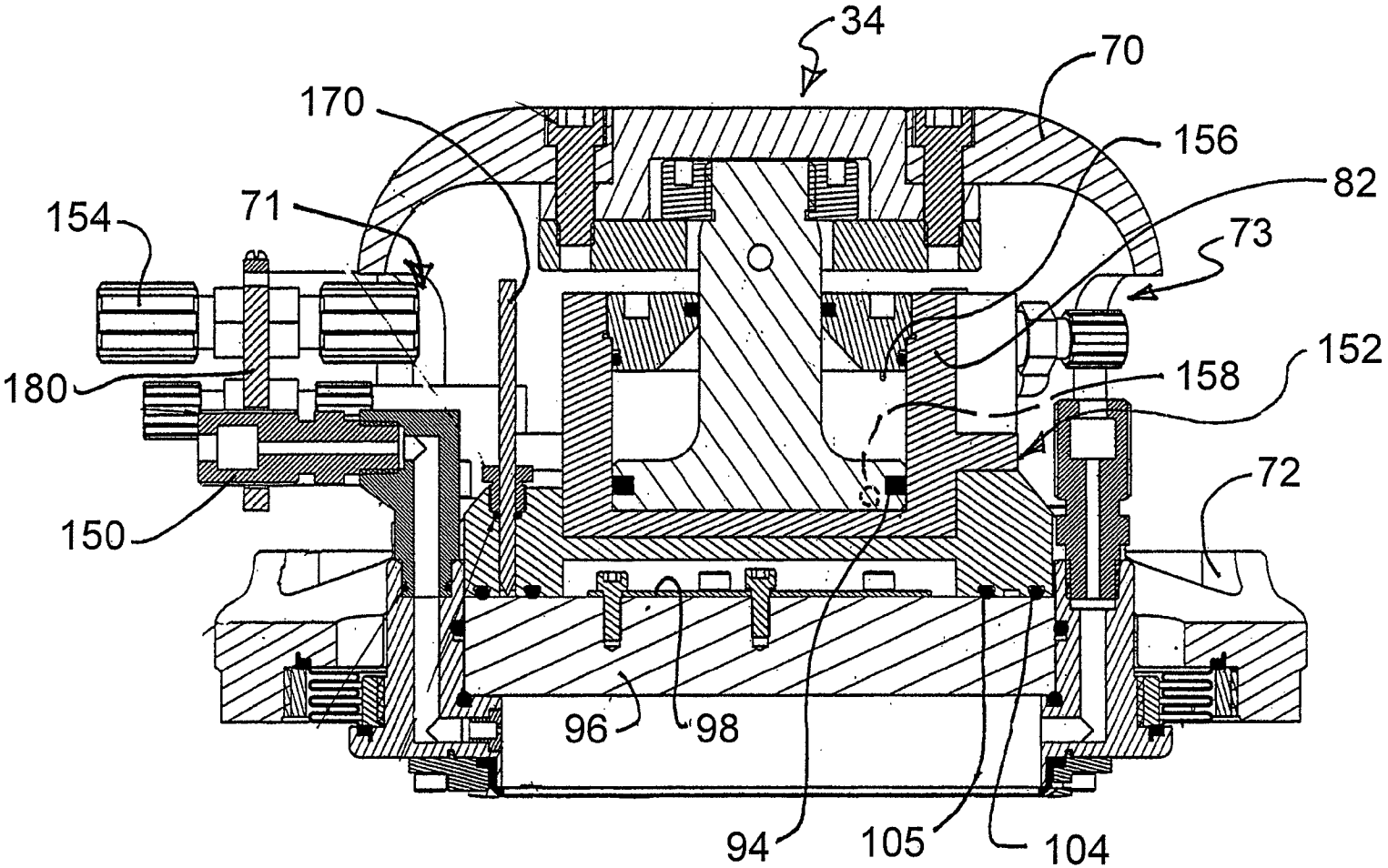
FIG. 9 is a section view taken along line 9-9 of FIG. 4 and showing the head of FIGS. 1-8 alone.

FIG. 9 shows the head 34 separated from the base 32. With the head retainer 48 released, in this case by pulling the cam handles 50 outwardly, the head 34 may be separated from the base 32. The electrical and fluid lines connecting to the head may be flexible, so that the head may be removed from the base without the need to break these connections.

FIG. 10 shows the head 34 separated from the base 32, and with the head cover 70 removed, for purpose of illustration. As shown in FIG. 10, the upper fitting bracket 180 and the optical flag plate 168 are attached to the cylinder ring 86. The cap screws 79 which ordinarily attach the piston cap 78 and the piston plate 80 to the cover 70 are shown in their assembled positions, but without the cover 70 in place. The upper optical sensor 162 and the lower optical sensor 164 are attached to the side wall of the cover 70. However, they are shown in FIG. 10 for purpose of illustration only. An alignment pin 182 in the electrode ring 106 may extend into a vertical slot on an inside surface of the head cover 70, to keep the head cover angularly aligned with the movable electrode assembly 152. As shown in FIGS. 1, 2 and 9, cylinder water supply and return lines extend from fittings 176 and 178 on the upper fittings bracket 180 to upper and lower cylinder ports 156 and 158 extending through the walls of the cylinder 82. Alternately supplying water under pressure through the upper and lower cylinder ports 156 and 158 hydraulically moves the moveable electrode assembly 152 between up or open and down or closed positions.

Figure 11:
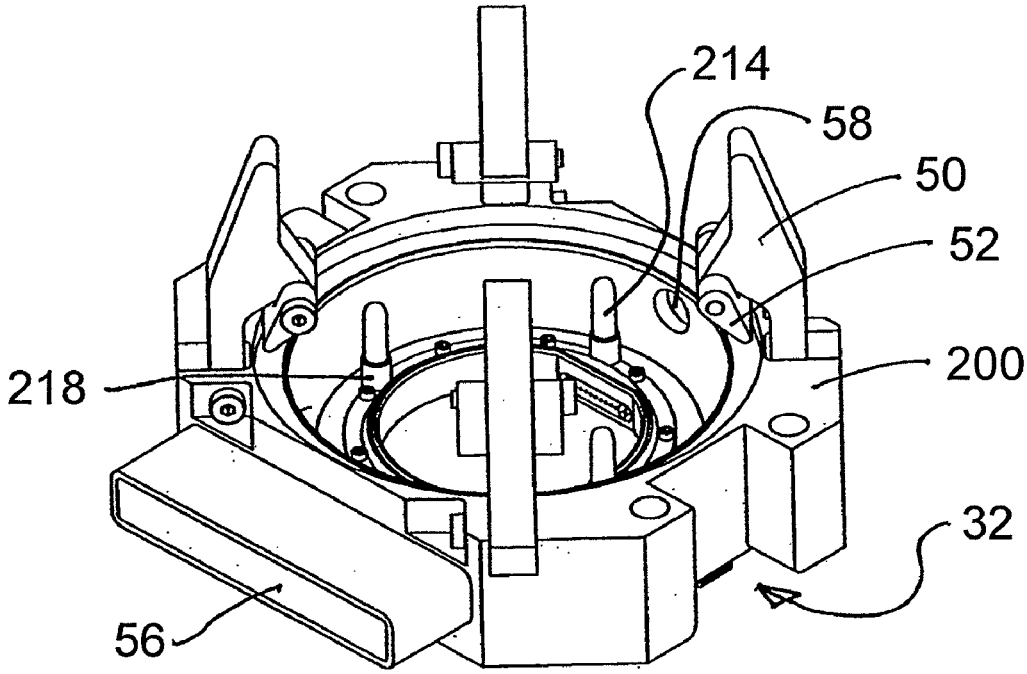
FIG. 11 is a top and front perspective view of the base shown in FIGS. 1-8, with FIG. 11 showing the base separated from the head.
Figure 12:
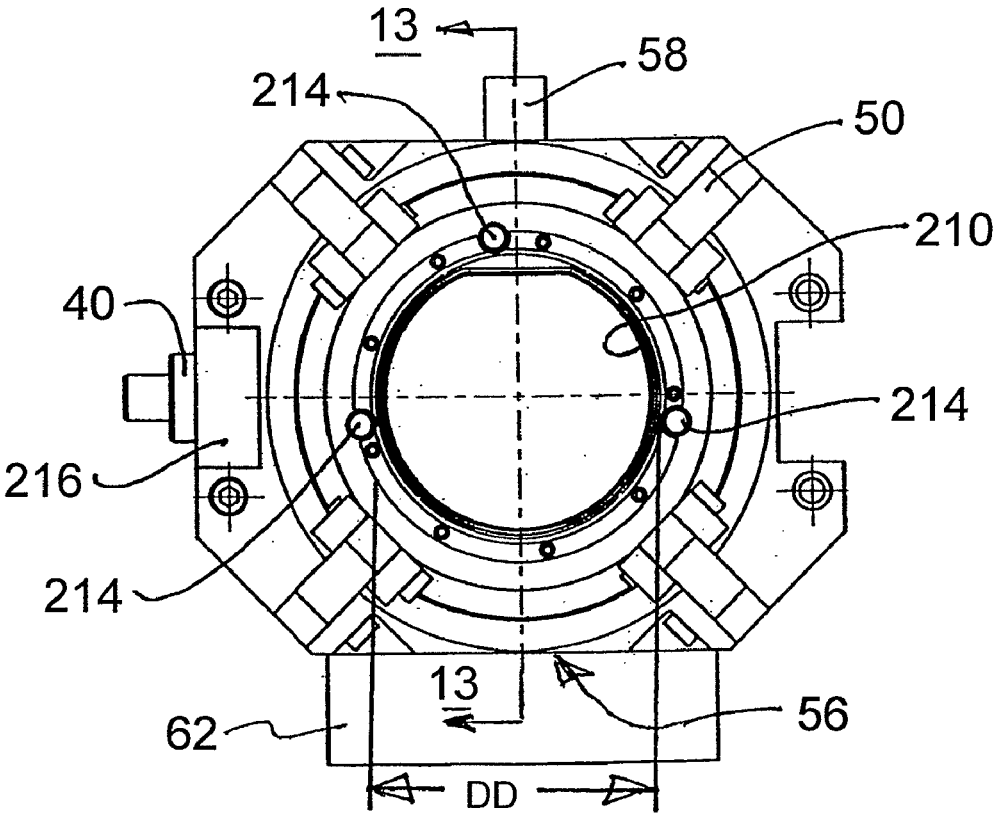
FIG. 12 is a plan view of the base shown in FIG. 11.
Figure 13:
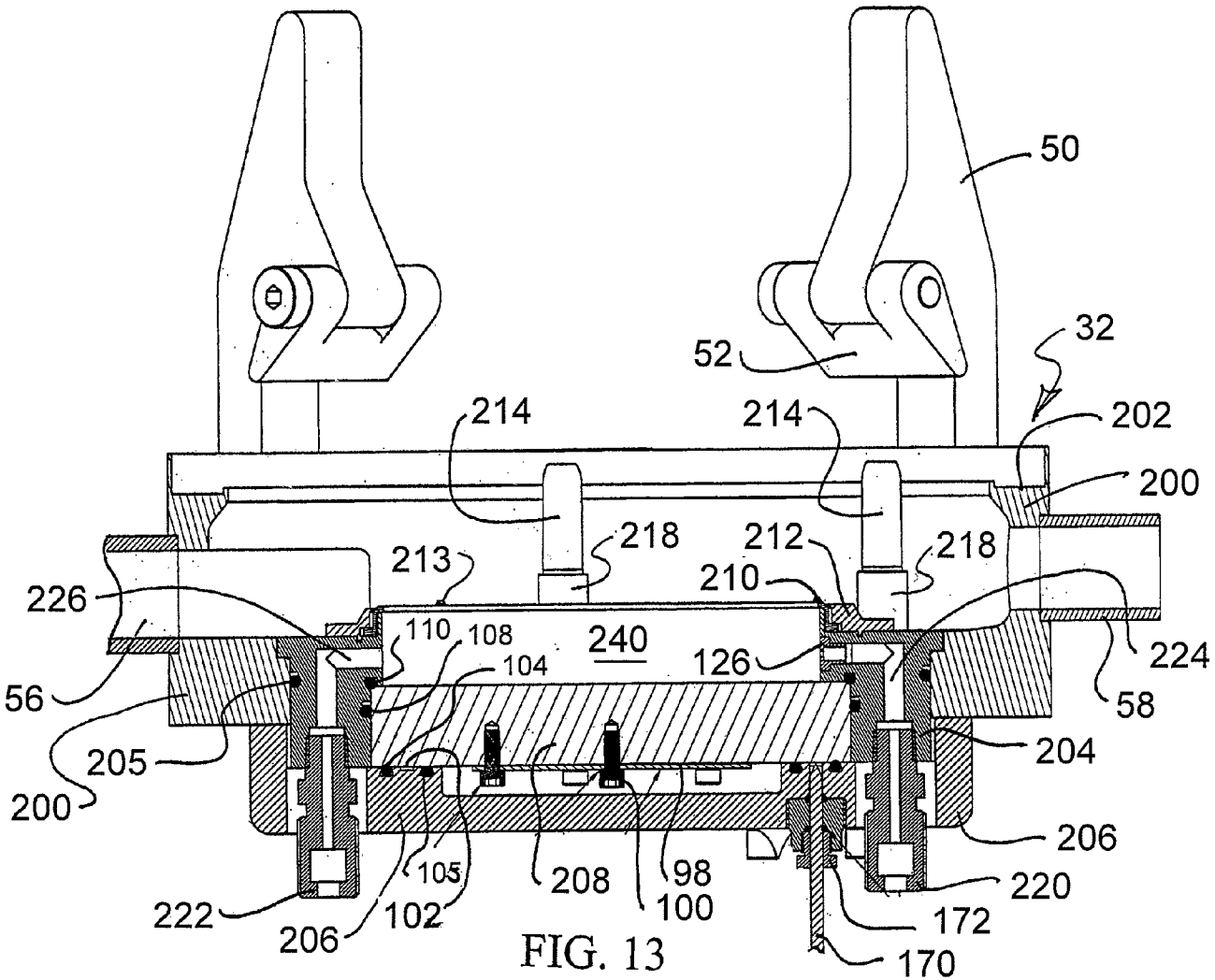
FIG. 13 is a section view taken along line 13-13 of FIG. 12.

FIGS. 11, 12, and 13 show the base 32 separated from the head 34. Referring to FIGS. 11, 12, and 8, three guide pins 214 project upwardly from a base electrode ring 204 into the bores 114 in the head electrode ring 106. A pin seal 215 seals the base of the pin against the base electrode ring 204, although in ordinary use, the guide pins 214 are not extensively exposed to the corrosive electrolyte liquid.

As shown in FIGS. 11 and 12, the two front guide pins 214, closest to the load slot 56, are spaced apart by a dimension DD which is nominally larger than the wafer diameter. The third guide pin 214 is located towards the back of the processor 30, closer to the containment drain 58. Referring to FIGS. 8 and 12, the guide pins 214 are located on a diameter concentric with and slightly greater than, the diameter of the seal 128. The lower section of each guide pin 214 has a shoulder 218 which may act as a hard stop to set the spacing between the seals when the processor is closed, thereby also setting a predefined amount of seal compression on the wafer.

Referring to FIG. 13, the base 32 has a base ring 200. A seal seat 202 at the upper end of the base ring 200 holds a containment seal 36, which is shown in FIG. 3. The containment seal 36 seals the head to the base to form the containment chamber. Similar to the head 34, the lower or second electrode 208 (in this case the anode) is secured in place in the base by a base electrode ring 204 and a base electrode cover 206. As in the head 34, the electrode 208 is sealed against the base electrode ring 204 by first and second seals 110 and 108. The base electrode ring 204 is similarly sealed against the electrode 208 by third and fourth seals 104 and 105 positioned on opposite sides of a groove 102. As in the head 34, an optical liquid detector 170 extends through the base electrode cover 206 to the groove 102. A buss plate 98 is similarly attached to the electrode 208, as described above with reference to the head 34 in FIG. 5. Referring to FIGS. 13 and 15, a base seal 210 is attached to the base electrode ring 204 by a base seal retainer 212 attached to the base electrode ring 204.

Wafer guides or protrusions 213 extend up slightly from the base seal retainer 212 as shown in FIGS. 5-8 and 16 and help with wafer alignment or positioning, when a wafer is placed onto the base seal 210, as described below. The upper or head seal 128 is generally the same diameter as the base seal 210. Indeed, the head and base seals may be the same. As shown in FIG. 3, the processor 30 may have seals 128 and 210 and other components adapted for processing a wafer having a flat edge. In this case the seals, seal retainers, and the electrodes may be generally D-shaped. For round wafers, these components may be round.

Figure 17:
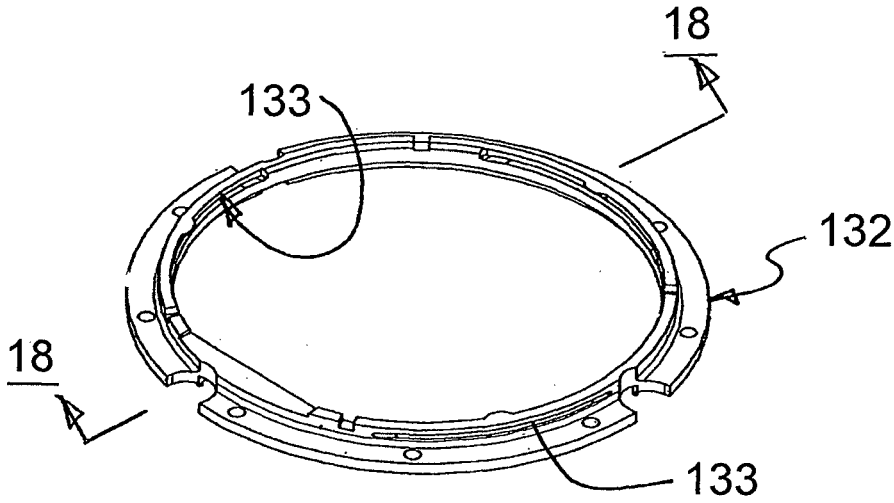
FIG. 17 is a perspective view of the upper seal retainer shown in FIGS. 14-15.
Figure 18:
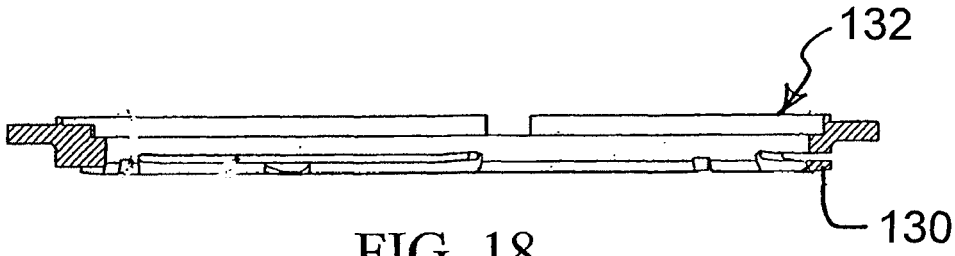
FIG. 18 is a section view taken along line 18-18 of FIG. 17.

Referring to FIGS. 15, 17 and 18, the upper seal clamp ring 132 has resilient ejector tabs 130 that press down slightly on the outer edge of the wafer, when the head seal 128 is engaged against the wafer 250. FIG. 15 shows in dotted lines the nominal position where the ejector tabs 130 would be with no wafer present. With a wafer present, the bottom surface of ejector tabs rest on the top surface of the wafer, at the outer edge of the wafer. The seal 128 and the upper seal clamp ring 132 are dimensioned so that as the movable electrode assembly 152 moves up away from the wafer 250, the seal 128 separates from the wafer first, while the ejector tabs 130 continue to hold the wafer down onto the base seal 210. This prevents any potential for having a wafer stick to the head seal 128 as the seal is lifted away from the wafer after processing.

As shown in FIG. 13, an electrolyte inlet fitting 220 leads into an inlet 224 in the base electrode ring 204. As in the head 34, a diffuser plate or similar liquid diffusing element 126 may be attached to the base electrode ring 204 over the inlet 224. With the base seal 210 in contact with a wafer, a base or lower process chamber 240 is formed between the electrode 208 and the wafer, with the lower process chamber 240 surrounded by the base electrode ring 204. An electrolyte outlet 226 runs from the lower process chamber 240 to an electrolyte outlet fitting 222. A diffuser plate 126 may also be provided over the electrolyte outlet 226.

Referring back to FIG. 5, a lower fitting bracket 228 is attached to the base electrode cover 206. The optical liquid detector 170 in the base 32 connects to a fitting 232 on the bracket 228, along with the electrolyte line connections, to provide strain relief. A lower electrode wire 234 extends through an electrical feed through fitting 230 in the electrode cover 206 and connects to the buss plate 98 on the electrode 208.

In the processor 30 shown in FIGS. 1-8, the electrode 96 in the head 34 is typically made the cathode, while the electrode 208 in the base 32 is typically made the anode, by selecting the polarity of the current source attached to each electrode. The electrodes 96 and 208 may otherwise be the same. Although various materials may be used, the design shown uses electrodes made from boron-doped silicon. Each electrode may be about 25 mm thick. The diameter of the electrodes may be substantially the same as the diameter of the wafer. The diameter of the head and base seals 128 and 210 is typically 2-10 mm less than the wafer diameter, providing, for example, an edge exclusion zone (the outer annular area of the wafer protruding beyond the seal) from about 1-5 mm. The electrode surface may be diamond coated. If used, the diamond coating is doped to make it electrically conductive.

As the electrolyte generally will include concentrated hydrofluoric acid, the components of the processor 30 coming in contact with the electrolyte are made of materials, such as Teflon (fluorine resins) or PVDF, which are resistant to corrosion by HF or other reactive electrolyte chemicals. The cap screws or other fasteners in the processor 30 generally may be made of similar plastic or non-metal materials. Referring to FIG. 5, the buss plates 98, electrode wire leads, and wire lead attaching screws are metal, as these components require high electrical conductivity. However, these may be the only metal components in the head 34. In addition, these metal components are sealed off from the electrolyte introduced into the process chambers 146 and 240 by the first seal 110, second seal 108, third seal 104, and the fourth seal 105.

In the event of any leakage around the electrode, electrolyte would first collect in the groove 102, and be detected by the optical liquid detector 170. In addition, the seal vents 116 and 118 will tend to divert any leaking electrolyte away from the back of the electrode. Upon detection of a leak, the controller shuts down the processor 30, before any electrolyte can move past the fourth seal 105. In this way, the electrolyte is entirely isolated from any metal in the processor 30. Metal contamination of the electrolyte or wafer, or inadvertent release of electrolyte into the head or base, is accordingly avoided.

The processor 30 provides highly uniform current flow through the process chambers 146 and 240, yet within a relatively small space. The clearance space around the processor 30, to allow it to rotate between horizontal and vertical positions, is also relatively small. Referring again to FIG. 5, the electrodes shown have a diameter of about 150 mm and a thickness of about 25 mm. For this type of design, an electrode (or wafer) diameter to electrode thickness ratio of about 4-10:1 may be used. The height of the chambers (dimension CC in FIG. 5) is also generally about the same as the electrode thickness in this example, with ratios of chamber height to electrode thickness ranging from about 2.5 to 1 to about 1 to 1 may be useful.

The height of the chambers, and/or the electrode thickness, can of course also exceed these ranges, although this may tend to make the entire processor larger, with no improvement in current uniformity. The diameter and height of the containment chamber 60 are not critical and may be selected to accommodate the size and/or shape of other internal processor components, within a compact space. While the drawings show the chambers 146 and 240 as having substantially the same height, one chamber may have a larger height than the other. The chambers 128 and 240 as described above have minimal diameter and height. In addition to providing for a compact processor, this also speeds up processing, since process liquids can be quickly filled and drained from the chambers. Typically, the containment chamber 60 may have a diameter of about 1.1 to 2 or 1.1 to 3 times the diameter of the seals 128 or 210 or the workpiece. The height of the containment chamber 60 may be from about %5-%50 of the diameter of the seals 128 or 210.

Operations of the processor 30 are generally controlled via an electronic controller, such as the controller 304 described below. In use, the processor 30 is initially loaded with a wafer 250. For loading (and unloading a wafer), the processor 30 is in the horizontal position as shown in FIG. 1. The terms horizontal and vertical here refer to the orientation of the wafer 250 within the processor 30. The moveable electrode assembly 152 in the head 34 is in the up position, as shown in FIGS. 5-9. A wafer is moved into the processor 30 through the load slot 56, typically by a robot. As the wafer moves into the processor, the edges of the wafer may contact the wafer guides 213 which protrude up from the base seal retainer 212. This properly centers and locates the wafer 250 relative to the seals 128 and 210. The wafer 250 may be loaded with either the front side or the back side facing the lamp assembly 270 or other light source. The wafer 250 is then released, with the wafer resting on the lower or base seal 210. The robot (or other wafer mover used) is withdrawn.

Figure 14:
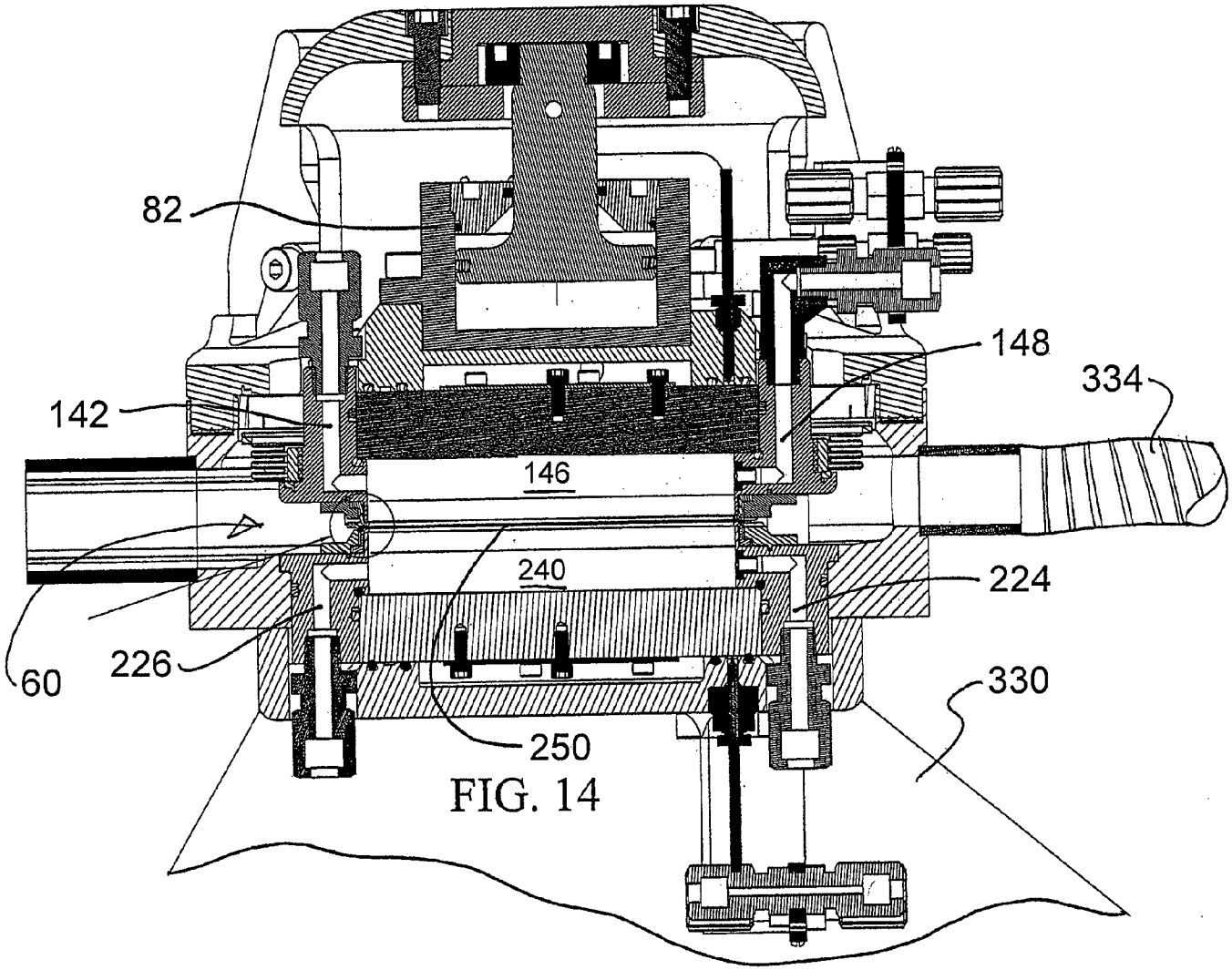
FIG. 14 is a section view taken along line 7-7 of FIG. 4 and showing the processor in a closed or processing position, with FIGS. 5-8 showing the processor in an open position, for loading and unloading a wafer.

The controller opens valves causing water to be supplied under pressure to the lower cylinder port 158. This drives the cylinder 82 and the entire moveable electrode assembly 152 downwardly. Referring to FIGS. 9 and 14, water within the cylinder 82 above the piston seal 94 flows out of the cylinder via the upper cylinder port 156 and out the processor 30 via a return line. The water is used only as a hydraulic fluid and does not come into contact with the electrolyte or wafer 250. Accordingly, water purity is not critical, so that standard tap water, under standard plumbing pressures, may be used. The moveable electrode assembly 152 continues to move down towards the wafer until it bottoms out on the hard stop provided by the shoulders 218 of guide pins 214. The lower position sensor 164 provides a signal to the controller confirming that the moveable electrode assembly is in the process position. The water pressure provided to the cylinder may optionally be regulated, although regulation is not necessary. The upper or head seal 128 is pressed into sealing contact with the top surface of the wafer 250. The base seal 210 is also in sealing contact with the wafer 250. The processor 30 is then in a closed position, as shown in FIG. 14. Water pressure may be maintained during processing.

Figure 4:
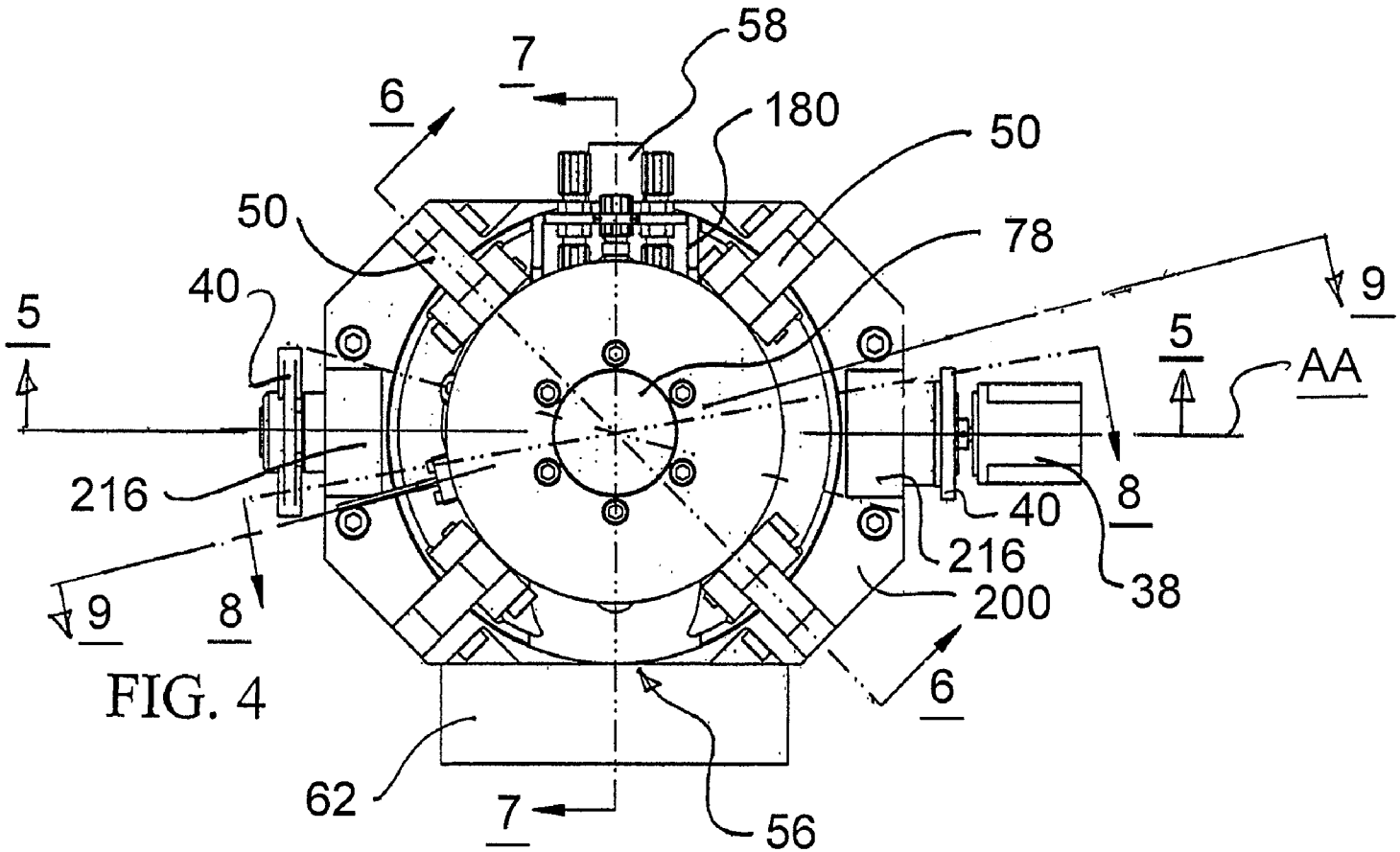
FIG. 4 is a plan view of the processor shown in FIGS. 1-3.

Referring momentarily to FIGS. 1-4, the controller actuates the rotate motor 38, pivoting the entire processor 30 about 90 degrees, so that the wafer 250 is moved into a vertical orientation, with the slot 56 facing up and with the drain 58 facing down. The rotate motor 38, or an equivalent driving element, may be supported on a deck 42 or other supporting surface. The processor 30 can be supported on a pair of pivot blocks 332 attached to the base 32. In FIG. 4, the pivot blocks 332 are attached to flange bearings 40 with the rotate motor attached to the right side pivot block 332, optionally through a gear drive reducer 39.

The controller then opens valves supplying electrolyte to the processor 30. Electrolyte flows into the upper and lower process chambers 146 and 240 through the inlets 148 and 224, and through the diffuser plates 126, as shown in FIGS. 7 and 14. The process chambers are filled from the bottom up. Valves controlling flow through the return lines 142 and 226 may be opened to allow the chambers to vent while filling with electrolyte, or during other times, or at all times during the processing.

Electrical current is applied to the electrodes 96 and 208. Current flows from the cathode or first electrode, through the electrolyte in the chamber 240, through the wafer, and through the electrolyte in the chamber 146 to the anode, or other electrode. The wafer is sufficiently conductive to provide a bi-polar electrode function. Electrolyte may be continuously provided at a low flow rate, so that the electrolyte in the chambers 146 and 240 is constantly refreshed, although without substantial fluid turbulence.

During processing, the chambers 146 and 240 are ordinarily virtually entirely filled with electrolyte to provide more uniform processing. Gasses generated during processing may be carried off via the circulation of electrolyte through the chambers 146 and 240. Alternatively, separate gas exhaust ports may optionally be used in the chambers 146 and 240. The motor 38 may be controlled to oscillate the processor 30 about a near vertical position, to assist with gas removal, mixing of liquid chemicals, or to help distribute process or rinsing liquids, either while the chamber is being filled with electrolyte, or during processing, or both. The process described produces amorphous porous silicon.

The electrolyte parameters, such as chemical composition, temperature, pressure, flow rate, concentration, etc., may be varied to achieve desired process results. Current flow may also be selected as desired. The current may be increased to a high enough level to transition from a porous silicon process to a wafer polishing process. The processor 30 may therefore be used for wafer polishing. The electrolyte may include water, relatively concentrated HF, and an alcohol, such as isopropyl alcohol. Processing continues, for example, for about 2-10 minutes, until the wafer surface 250 is sufficiently etched and becomes porous silicon. Electrical current is turned off. The electrolyte is drained from the chambers. The chambers and workpiece may then be rinsed by filling the chambers with a rinse liquid, such as de-ionized water, and then draining the rinse liquid. The rotate motor 38 is actuated in the reverse direction, to pivot the processor 30 back into the horizontal position shown in FIG. 1.

The controller then supplies water pressure to the cylinder 82 in the reverse direction, to lift the moveable electrode assembly 152 up and away from the wafer 250. As shown in FIG. 15, the ejector tabs 130 on the upper seal clamp ring 132 hold the wafer 250 down onto the base seal 210 until the head seal 128 is separated from the wafer 250. This prevents the wafer 250 from inadvertently sticking to the head seal 128. The wafer is then removed from the processor 30, again, typically via a robot grasping the edges of the wafer 250 from above, and withdrawing the wafer out of the processor 30 through the load slot 56. The processor 30 is then ready to process a subsequent wafer 250. The rotate motor 38 may optionally gently or even rapidly rock or oscillate the chamber 30 at various times, to help to agitate the electrolyte, displace gas bubbles, provide mixing of other chemicals that may be used, or to help distribute rinsing liquid. A gas, such as heated nitrogen, may also optionally be provided into the processor for drying the wafer.

In some applications, the processor may operate with the chambers filled with electrolyte or other process liquid, but with no electrical current flowing. Since the processor is well designed to operate with highly reactive or corrosive electrolyte, it can also operate with other reactive or corrosive process liquids, including HF, without use of electricity. This provides a purely chemical process, rather than an electrochemical process. Since the chambers 128 and 240 are sealed off from each other, different process liquids may be provided into each chamber, simultaneously or sequentially. Consequently, the front or device side of the wafer and the back side of the wafer may simultaneously be processed using different process liquids and/or gases. With this type of processing, the process liquids may optionally be introduced into the chambers 128 and 240 with the wafer in a horizontal orientation, or in a vertical orientation. If the processor 30 is intended for non-electrical processing, the electrodes may be removed and the electrode rings simply replaced with plates to form the upper and lower process chambers. In addition, the seals 128 and 210 may be designed to seal directly against each other, without contacting the wafer at all, and with the wafer supported within, rather than on, the lower seal 210.

Some wafers may be provided with a mask to determine which areas of the wafer are made porous. After electrochemical processing, electrical current may be turned off, additional chemical processing steps may be performed, with or without changes to the electrolyte, to etch off the mask, or another layer or film on the wafer.

Figure 6:
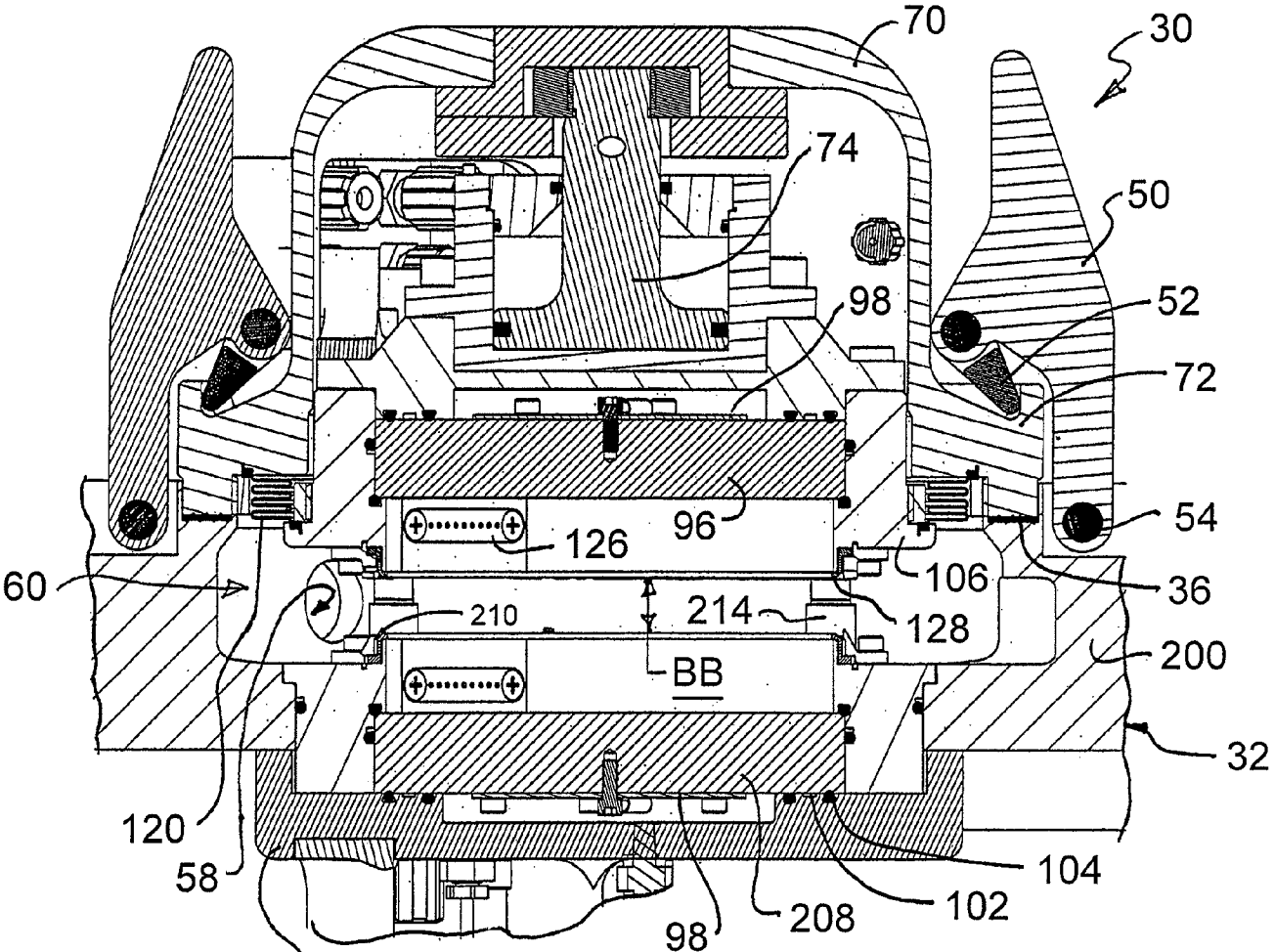
FIG. 6 is a partial section view taken along line 6-6 of FIG. 4.

Referring to FIGS. 5, 6, and 7, during processing the electrolyte is sealed within the upper and lower process chambers 146 and 240. These process chambers are surrounded by the containment chamber 60, which is open at one side at the load slot 56, and at the opposite side at the containment drain 58. However, there is no other fluid pathway out of the containment chamber 60. The bellows 120 seals the upper electrode ring 106 to the cover 70. Accordingly, a rinse liquid, such as water, may be provided into the containment chamber 60 via the load slot 56, to rinse all exposed surfaces within the containment chamber 60. The containment chamber itself may also be provided with rinse nozzles 252 connected to a rinse liquid source as shown in FIG. 5, for rinsing the chamber.

The rinse liquid may be provided between wafer processing, while the processor is open and the seals 128 and 210 are completely exposed. This allows virtually all surfaces of the seals to be rinsed, removing any trapped or adhering electrolyte. Rinsing can advantageously be performed with the processor 30 once again rotated into the vertical orientation, with the rinse liquid flowing via gravity through the containment chamber 60 and draining out of the containment drain 58. Rinsing with the chamber open allows the processor to maintain uniform process start up conditions, since a complete rinse of all surfaces contacted by electrolyte (or other process chemicals) may be achieved between each process cycle.

The substantially non-conductive rinse liquid may also optionally be flowed through the containment chamber 60 while the processor is closed, during actual processing of a wafer. Since the electrolyte is sealed within the process chambers 146 and 240, the rinse liquid does not come into contact with the electrolyte, and the rinse liquid only contacts the outer seal surfaces and the annular edge of the wafer extending radially outwardly beyond the seals 128 and 210 (typically by about 2-6 mm). Since the electrolyte is an electrical conductor, any leaking electrolyte may alter the otherwise uniform conduction path provided by the processor 30. This can cause non-uniform processing. Running rinse liquid through the containment chamber during processing will remove any leaking electrolyte, thereby maintaining the uniform conduction path necessary for providing high quality porous silicon.

The rinse liquid may also be provided into or through the containment chamber upon detection of an electrolyte leak or other fault condition, to carry away any leaking or exposed electrolyte. One example of a containment chamber rinse system is described below in connection with an automated processing system.

Figure 19:
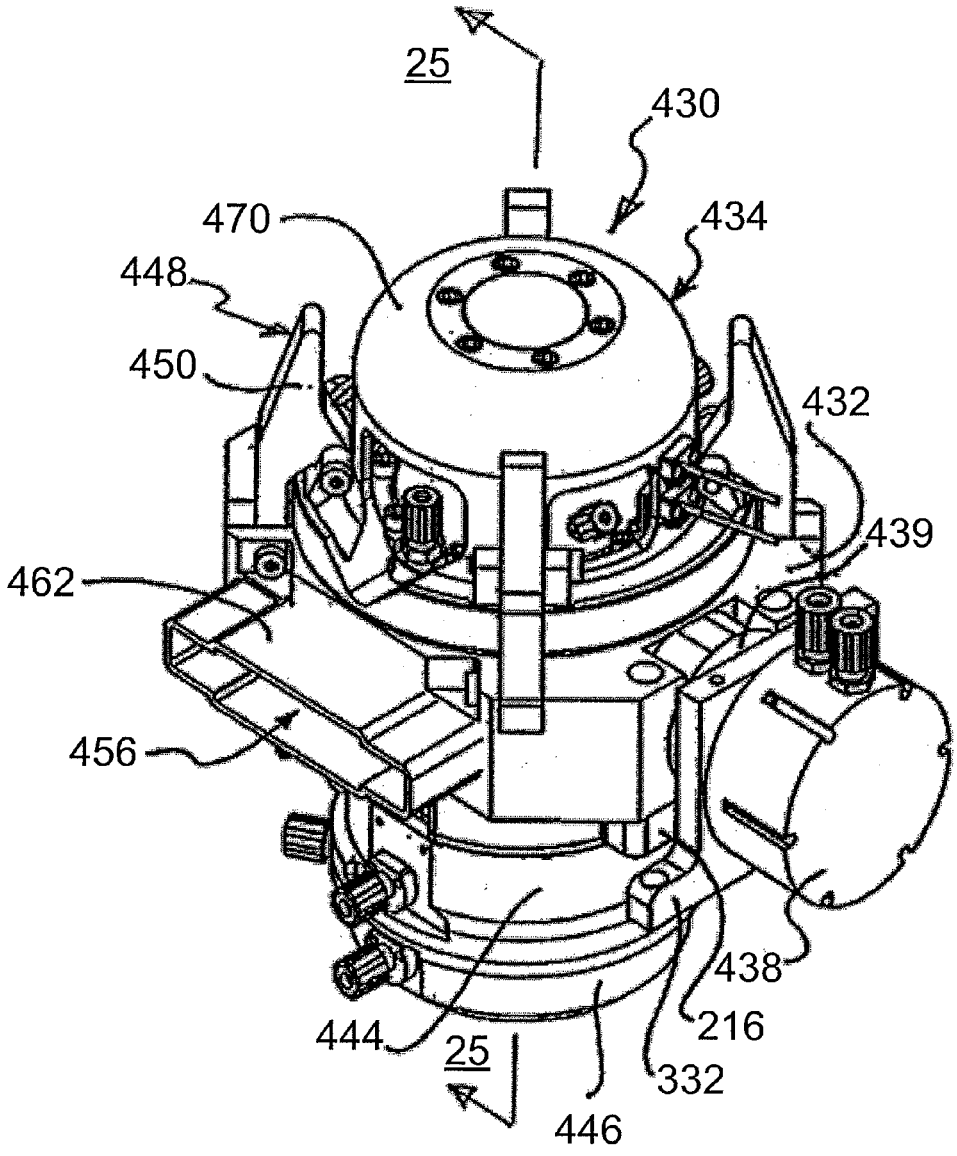
FIG. 19 is a top and front perspective view of a porous silicon processor.
Figure 20:
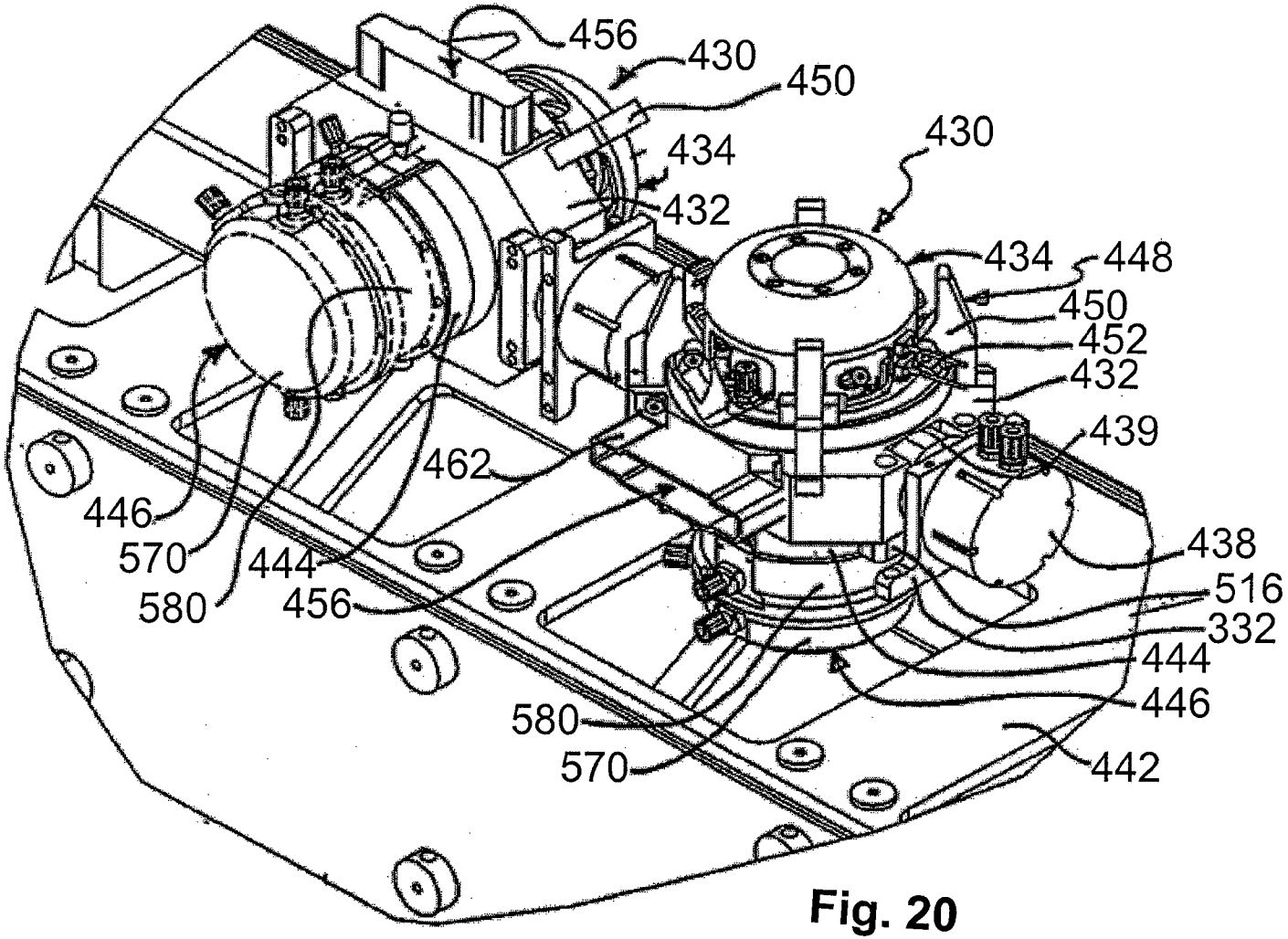
FIG. 20 is a top and front perspective view of two of the processors shown in FIG. 19 provided in a processing system. The processor on the right is in a load/unload position. The processor on the left is in a process position.

Another design for use in an illuminated process, as shown in FIGS. 19 and 20, has a head 434 attached onto a top or first side of a base 432. An anode assembly 444 is attached to the bottom or second side of the base 432. An illumination module 446 is shown here attached to the anode assembly 444. The head 434, base 432, anode assembly 444 and the illumination module 446 form an electro-chemical processor 430. Referring to FIGS. 19 and 20, a motor or other actuator, such as a rotate motor 438, can pivot the entire processor 430. The processor 430 on the right side in FIG. 20 is shown in an upright or load/unload position. The processor 430 on the left side in FIG. 20 is pivoted about ¼ turn into a process position.

Figure 25:
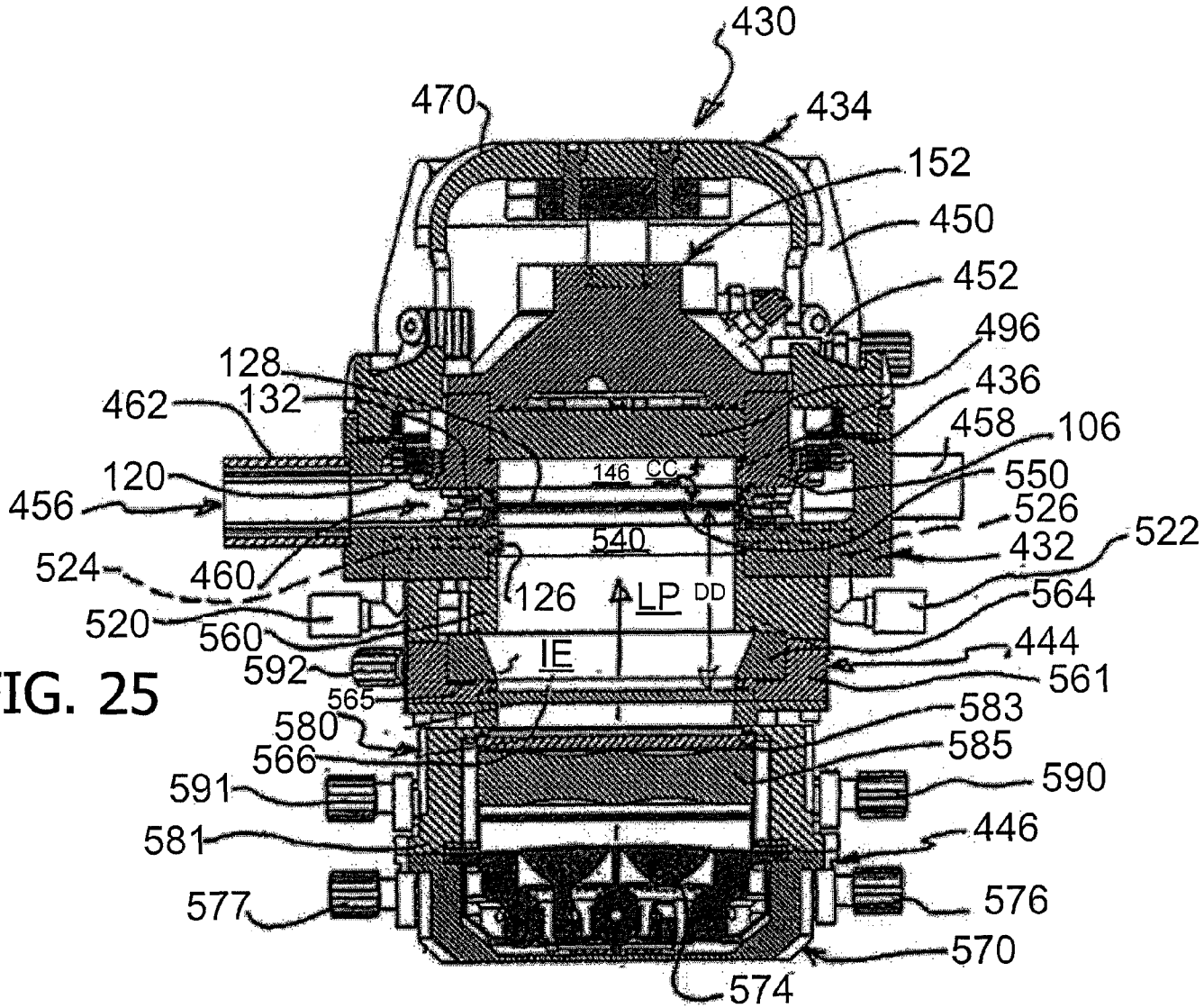
FIG. 25 is a section view taken along line 25-25 of FIG. 19.

Referring momentarily to FIG. 25, the head 434 may be the same as the head 34 shown in FIGS. 1-3 and described above. Accordingly, the design and separate operation of the head 434 is not repeated here. All steps or elements described above relative to the processor 34 may be used as well in the processor 434.

Figure 22:
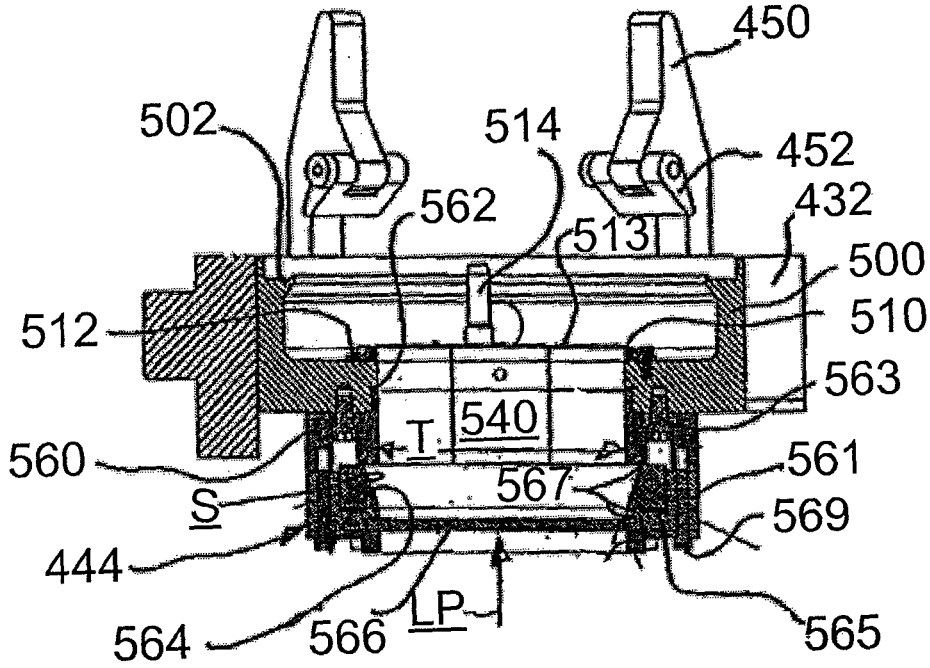
FIG. 22 is a section view taken along line 22-22 of FIG. 21

Referring to FIG. 22, the base 432 has a base ring 500. A seal seat 502 at the upper end of the base ring 500 holds a containment seal 436, which is shown in FIG. 3. The containment seal 436 seals the head 434 to the base 432 and forms the containment chamber 460. As shown in FIG. 22, the anode assembly 444 is attached to the side of the base ring 500 opposite from the head 434, e.g., on the bottom of the base 432. A tunnel section 560 of the anode assembly is shown in FIG. 22 attached onto the base ring 500 via screws 563. A tunnel seal 562 seals the upper rim of the tunnel section against the base ring 500. An annular electrode (here an anode) 564 is secured within an anode housing 561. The front or top end of the anode 564, and the back or bottom end of the anode 564, are sealed via anode seals 567 against the bottom of the tunnel section 560 and the anode housing 561, respectively. An electrically conductive ring contact 565 is positioned between the anode 564 and the anode housing 561. An electrical lead or wire (not shown) is connected to the ring contact 565. Electrical current is provided to the lead via the connector 592 shown in FIG. 25. The lower or anode process chamber 540, which is filled with a process chemical liquid during processing, is sealed off from the ring contact 565 by the seals 567.

A window 566 is held in place on the anode housing 561, by a window clamp ring 568. The window 566 is also sealed against the anode housing 561 via a seal 567. The window clamp ring 568 may be attached to the tunnel section 560 via screws 569. The window may be sapphire. As shown in FIG. 22, the anode 564 is ring-shaped, and may be dimensioned so that all sections of the anode are positioned outside of the dimension of diameter T. Consequently, the anode 564 does not block light path LP extending from the illumination module 446 to the wafer 550.

The anode 564 may have a conically tapered inner surface S, as shown in FIG. 22. The angle AA of the surface S generally ranges from about 10-30° or 15-25°. The angle AA of the surface S may provide more uniform electrical current flow across the electrolyte to the wafer surface. The anode 564 may also be made with straight and perpendicular surfaces, with no angled surface. However, with this design, more current may flow from the electrode surface closest to the wafer, as this would be the least resistive path. The maximum inner diameter of the anode 564 will typically vary with the diameter of the wafer to be processed. The drawings show a processor adapted for processing a 6 inch (150 mm) diameter wafer. However, the processor 430 may of course be scaled up or down for processing other size wafers.

The seals such as seals 562 or 567, as well as various of the other seals shown in the drawings, may be o-rings or similar seals, made of a material compatible with process chemical liquids used in the processor. Although various components of the anode assembly 444, as well as various others, are shown as held together with screws, various other attachment techniques may also be used, such as via adhesives, welding, clamping, fasteners, unitary construction, etc.

Figure 23:
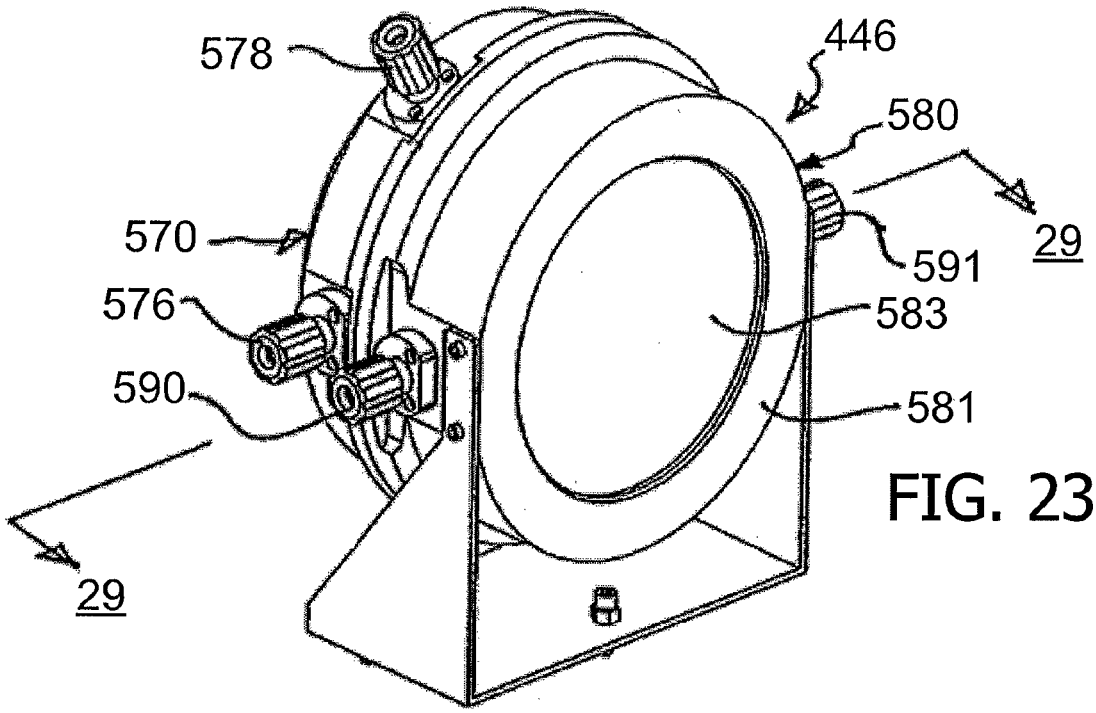
FIG. 23 is a front perspective view of the anode assembly and the lamp assembly shown in FIGS. 19 and 21, with the anode assembly supported on a test stand.
Figure 24:
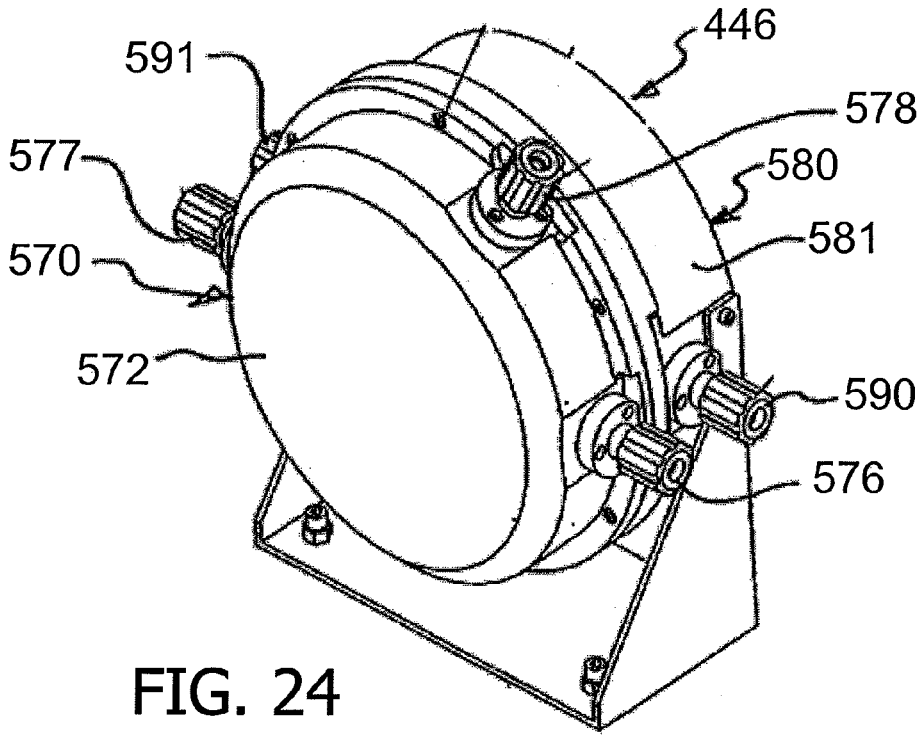
FIG. 24 is a rear perspective view of the anode assembly and the lamp assembly as shown in FIG. 23.
Figure 26:
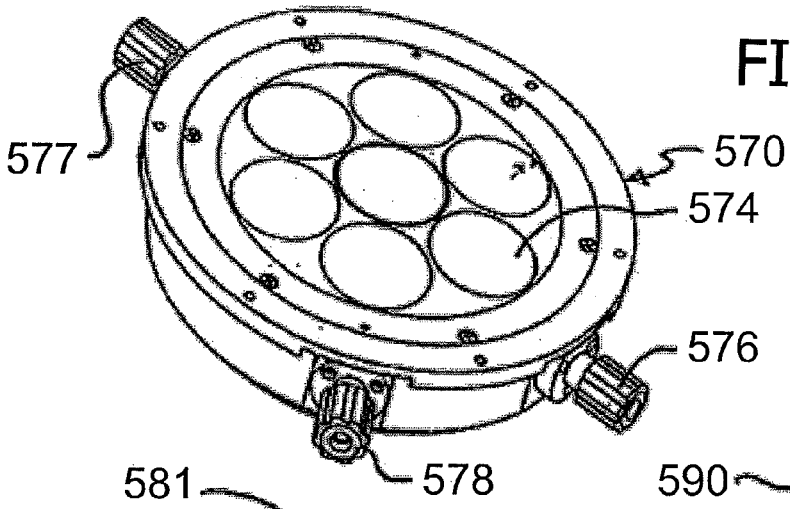
FIG. 26 is a front perspective view of the lamp assembly shown in FIGS. 23-25.
Figure 30:
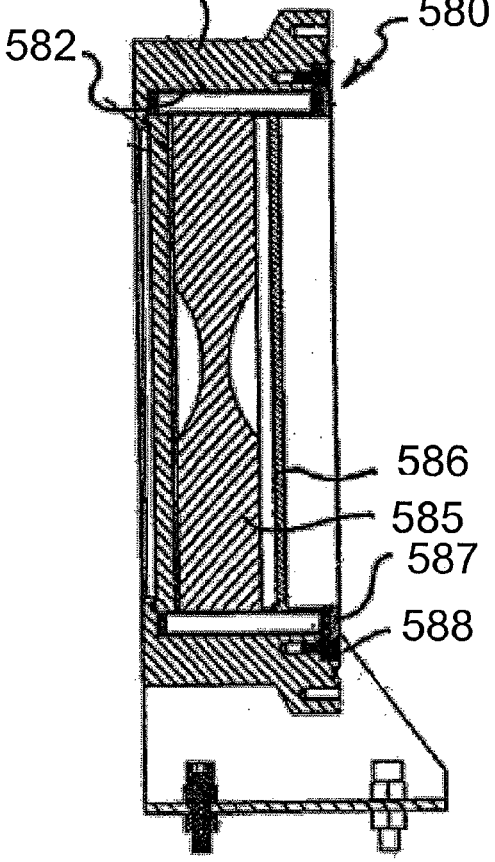
FIG. 30 is a section taken along a line rotated about 30 degrees from line 29-29 in FIG. 23.
Figures 27, 28:
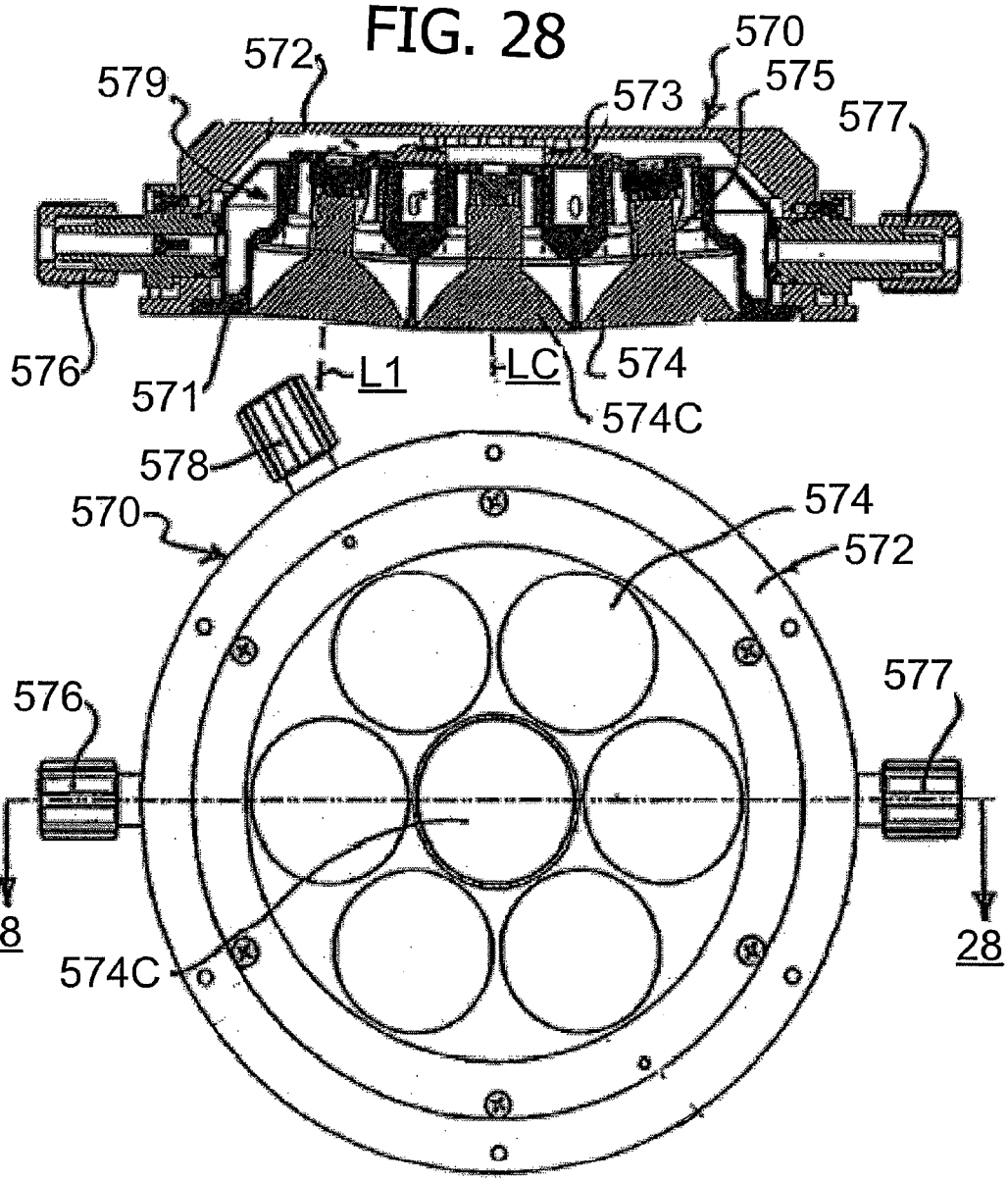
FIG. 27 is a front view of the lamp assembly shown in FIG. 26.
FIG. 28 is a section view taken along line 28-28 of FIG. 27.

As shown in FIGS. 23-25, the illumination module 446 can be attached to, and may be generally concentric with, the anode assembly 444. The illumination module may be attached to the bottom or back of the anode assembly 444 via mechanical fittings or fasteners. The specific illumination module 446 shown here includes a lamp assembly 570 and a reflector assembly 580. The design details of the lamp assembly and the reflector assembly may be changed with specific applications. The reflector assembly, in some designs, may be omitted. Turning to FIGS. 26-28, the example of the lamp assembly 570 shown in these drawings includes multiple lamps 574 supported in lamp holders 575 on a lamp housing 571. Liquid coolant fittings 576 and 577 connect to a coolant channel 579 formed within the lamp housing, as shown in FIG. 28. Electrical power is provided to the lamps 574 by a cable connecting through an electrical fitting 578 and attached to a pair of semicircular buss bars 573. A housing cover 572 covers the back of the lamp housing 571.

As shown in FIGS. 26 and 27 in this example of a lamp assembly 570, seven lamps or bulbs 574 are used in a symmetrical pattern. Specifically, six lamps are arranged on a circle, generally at 60° intervals, and surrounding a seventh central lamp. The specific lamps 574 shown are 37 watt, 12V, halogen lamps with a 40° spot beam. As shown in FIG. 28, the six lamps 574 around the central lamp 574C are aimed slightly outwardly. The angle between the axes L1 of each surrounding lamp 574, and the axis LC of the central lamp 574C, is about 2-6° or 3-5°. A lamp assembly 570 with this design provides uniform lighting when used with the reflector assembly 580 described below. Other lamp assemblies having varying numbers and configurations of lamps may be used in other processor designs to similarly provide uniform lighting.

Figure 21:
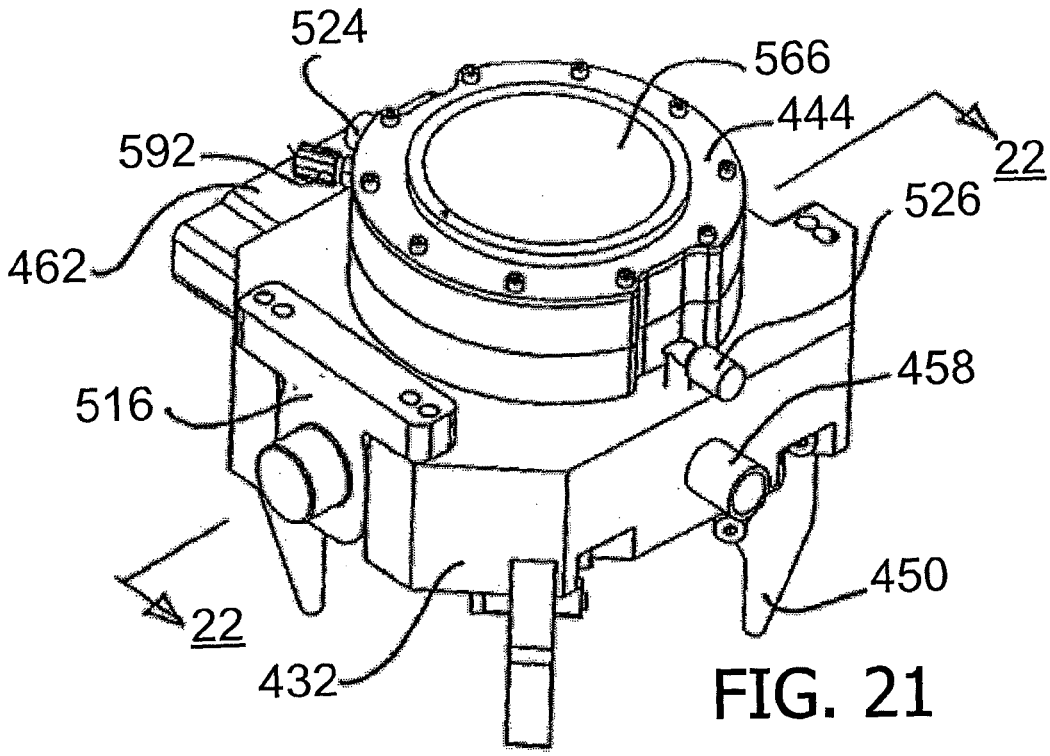
FIG. 21 is bottom perspective view of the base, the anode assembly and the lamp assembly shown in FIG. 19.
Figure 29:
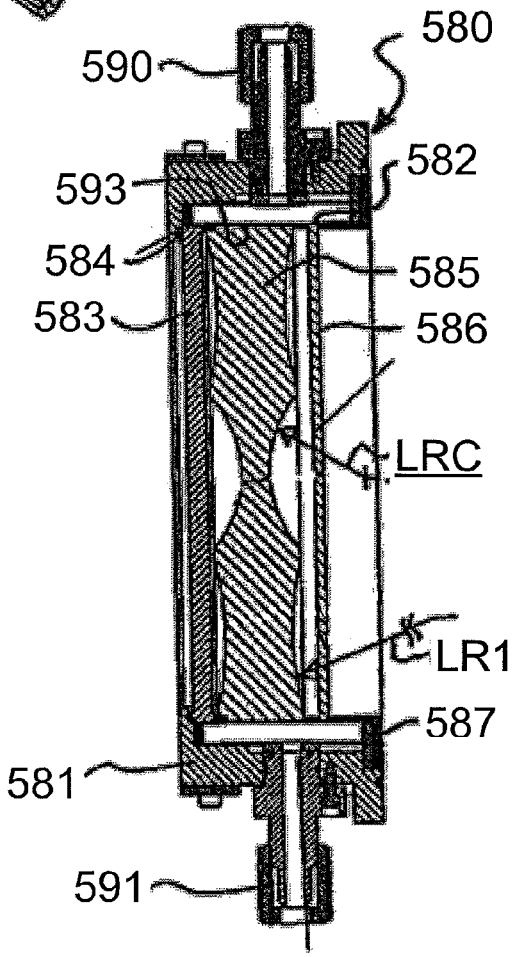
FIG. 29 is a section view taken along line 29-29 of FIG. 23.

Turning to FIGS. 23, 24, 29 and 30, the reflector assembly 580 has a reflector 582 within a reflector cover 581. Liquid coolant fittings 590 and 591 connect into a coolant channel within the reflector 582. A lens 585 is positioned within the reflector cover 581 between a window 583 and a diffuser 586. The inside surfaces 593 of the reflector 582 (facing the lens 585) are highly reflective. The window 583, which may also be sapphire, can be sealed to the cover 581 using a seal element 584. The diffuser may be ground glass or another light diffusing component. A front retaining ring 587 is attached to the reflector cover by screws 588 and secures the diffuser, lens and window in place. Referring to FIG. 29, the lens 585, which is typically also ground glass, has a central radiused area LRC aligned with the central lamp 574C and surrounding radiused areas LR1 aligned with the six surrounding lamps 574. The radius at LRC is about 1.5 inches, and the radius at LR1 is about 4 inches in the lens 585 shown in FIG. 21.

Since the illumination module 446, which includes the lamp assembly 570 and reflector assembly 580, provides light into the processor, the illumination module need not be actually physically attached to the processor 430. Rather, the illumination module 446 may optionally be provided as a separate unit supported on or near the deck 442 or other structure, and not attached to the processor. As shown in dotted lines in FIG. 20, by separating the illumination module 446 from the rest of the processor 430, the length or height of the processor is reduced. The processor 430 then requires less clearance space to pivot between the two positions shown in FIG. 20. In this design, the illumination module may be fixed in place and positioned to shine light through the window 566 of the anode assembly, when the processor is in the process position shown at the left side of FIG. 20. However, by moving the illumination module 446 to a position closely adjacent to the window 566, after the processor is pivoted into the process position, improved lighting efficiency may be achieved. The illumination module may therefore be supported on a track, swing arm, or other mechanism to move the illumination into a position adjacent to, or even in contact with, the window or the anode assembly, during processing, and then moving the illumination out of the way, to allow the processor to pivot back to the load/unload position shown at the right side of FIG. 20.

As shown in FIG. 25, an electrolyte inlet fitting 520 leads into an inlet 524 in the base 432. As in the head 434, a diffuser plate or similar liquid diffusing element 126 may be attached over the inlet 524. With the base seal 510 in contact with a wafer 550, a lower or anode process chamber 540 is formed between the window 566 and the wafer 550, with the anode 564 near the bottom of lower process chamber 540. An electrolyte outlet 526 runs from the lower process chamber 540 to an electrolyte outlet fitting 522 on the base 432. A diffuser plate 126 may also be provided over the electrolyte outlet 526.

In the anode assembly 444, the ring contact 565 and wire lead are sealed off from the process chamber 540 via the seals 567. Leak detectors 170 and seal vents 116 as used in the head 34 or 434 may similarly be provided in the anode assembly 444. As the window 566 of the anode assembly 444 forms the bottom end of the process chamber 540, the illumination module 446 is not exposed to electrolyte during normal operations. In the event of a leak from the process chamber, the containment chamber prevents electrolyte from contacting and corroding other areas of the processor.

Turning once again to FIG. 25, the bottom or anode process chamber 540 has a height DD which is about 2-5 or 3-4 times greater than the height CC of the top or cathode process chamber 146. The dimension DD is measured from the top surface of the window 566 to the wafer 550 (with the processor 430 in the closed or process position as shown in FIG. 25). The inner diameter of the anode designated IE in FIG. 25 is generally the same as, and concentric with, the diameter of the seal 510. To provide a compact processor 430 that still provides highly uniform current flow, the dimension DD is typically about 60-100% or 70-90% of the dimension IE. Dimension DD is larger than dimension CC to allow more tunnel length, which provides a more spatially uniform current flow across the wafer (since current flows from an annular anode rather than from a disk anode).

In use, the head 434 may operate in the same way as the head 34 described above. In operation of the processor 430, the lamps 574 are turned on, and liquid coolant, such as water, is pumped through the coolant channel 579 in the lamp assembly. Liquid coolant is similarly pumped through the cooling channel ring in the reflector assembly 580. Light from the lamps 574 is focused by the lens 585, and is diffused by the diffuser 586. This creates a generally uniform beam shining on the bottom side of the wafer 550. The use of light, electrical current, and liquid process chemicals in the electrolyte, processes the silicon wafer 550 into porous silicon. Current flow across the wafer 550 may be monitored. As processing progresses, resistance often decreases, resulting in an increase in current flow. Voltage provided to the electrodes, and/or the intensity of the lighting, may accordingly be adjusted during processing.

The electrolyte and process parameters in the processor 434 may be the same as in the processor 34 as described above. After processing is completed, the lamps 574 and the electrical current to the electrodes 496 and 564 is turned off. The electrolyte is drained from the chambers. The chambers and workpiece may then be rinsed by filling the chambers with a rinse liquid, such as de-ionized water, and then draining the rinse liquid. A gas, such as heated nitrogen, may optionally be provided into the processor for drying the wafer. The rotate motor 438 is actuated in the reverse direction, to pivot the processor 430 back into the horizontal position shown on the right side in FIG. 20.

If desired, the processor 434 may be operated without lighting or current flow. This provides a purely chemical process, rather than an electro-photo-chemical process. The processor 430 may also be configured to provide photochemical processing, by exposing the wafer or workpiece to light and process chemical liquids, without any electrical current flow provided. The lamps 574 in this instance may be UV lamps. The processor 430 may also be operated with lighting but without current flow, in a photo-chemical process.

The anode assembly 444, or even just the anode ring 564, may be used in a processor having no light source. In this non-illuminated design, nozzles may be positioned to spray a fluid through the central open area of the anode ring 464 and onto the wafer, e.g., for rinsing. In this design, the illumination module 446 may be replaced with a nozzle or spray module 446.

Figure 31:
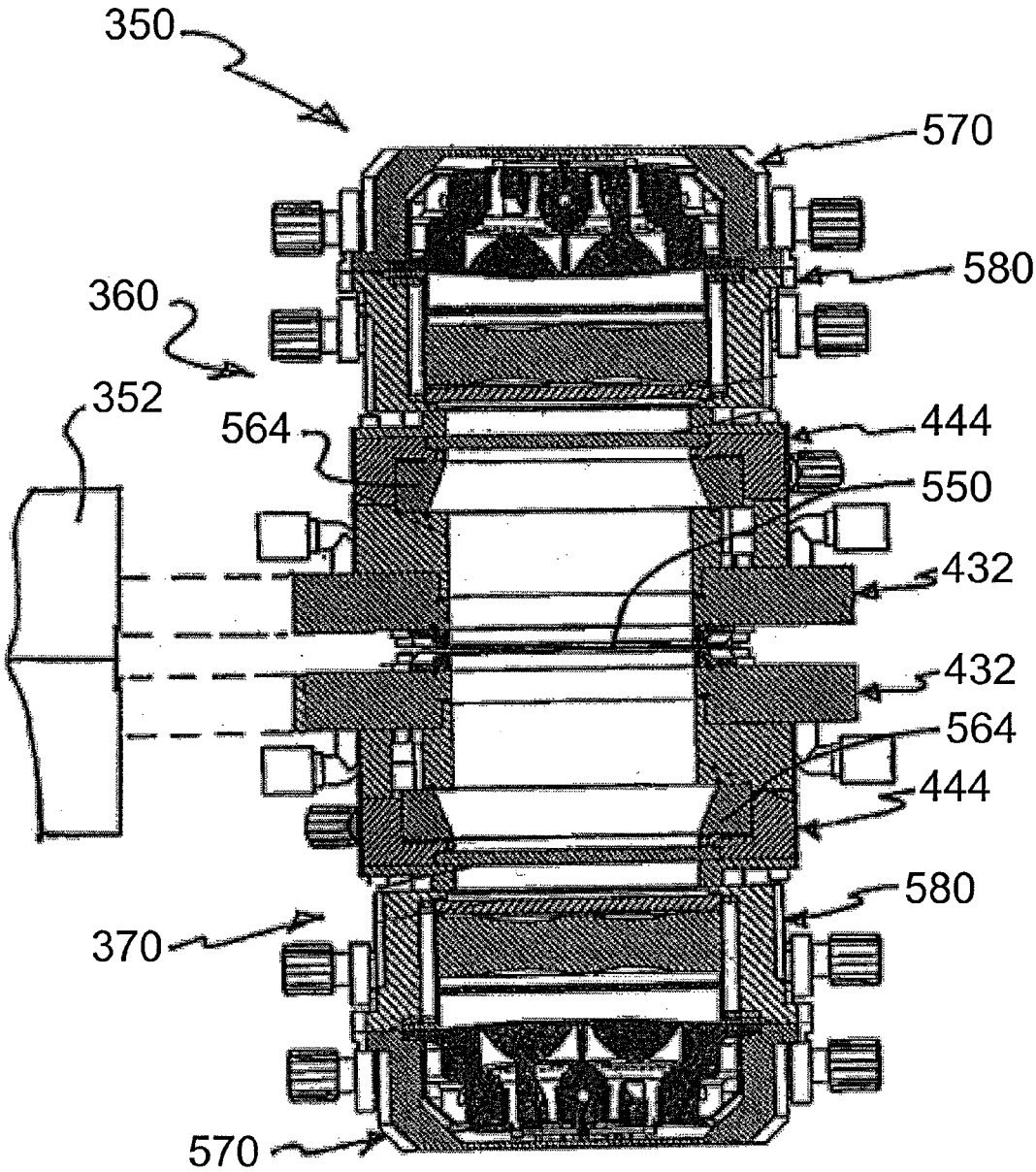
FIG. 31 is a section view of an alternative embodiment.
Figure 32:
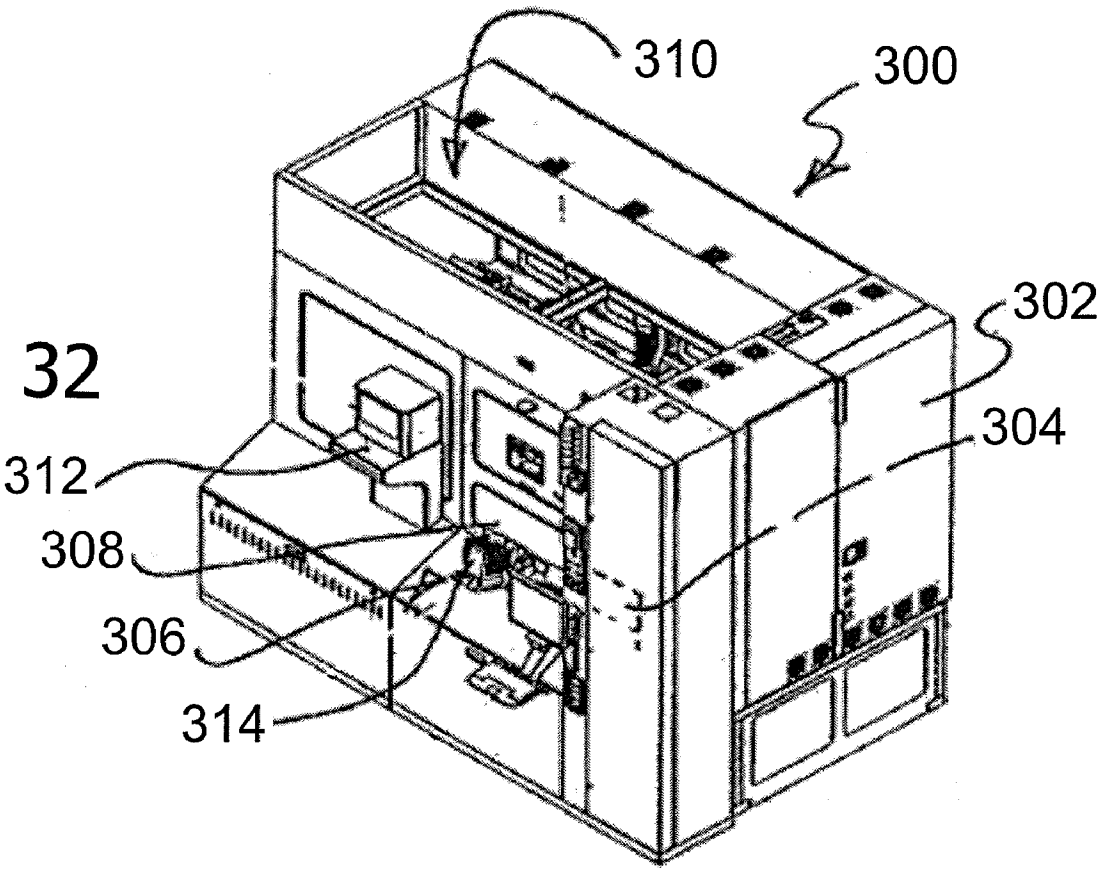
FIG. 32 is a perspective view of an automated processing system.
Figure 35:
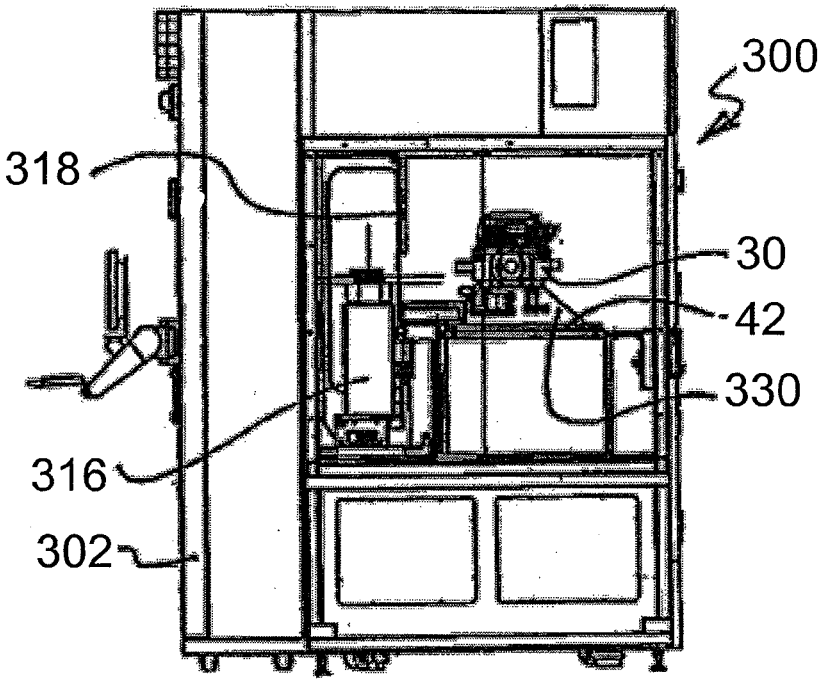
FIG. 35 is a side view of the system shown in FIG. 32.

As shown in FIG. 31, an alternative processor design 350 may have an anode assembly 444, a reflector assembly 580, and a lamp assembly on both sides of the wafer 550. In this design, both sides of the wafer may be simultaneously illuminated. One electrode ring 564 may be made the anode and the other electrode ring may be made the cathode. The combination of the base 432, anode assembly 444, the reflector/lens assembly 580, and the lamp assembly 520 above and below the wafer 550, form first and second light tunnel electrode units 360 and 370. An actuator 352 moves one or both of the light tunnel electrode units, to make and break the seal with the wafer 550.

As shown in FIGS. 32-35, the processor 30 or 430 may be used in an automated processing system 300. For purpose of explanation though, the description below of FIGS. 32-35 will refer only to the processor 30. Various types of automated systems may be used, including varying numbers of processors 30, arranged in whichever way (e.g., linear array, arcuate array, vertically stacked, etc.) may be preferred. In the automated system 300 shown in FIGS. 32-35, two processors 30 and two spin rinse dryers 322 are provided within an enclosure 302. A load window 308 is provided at a load/unload station 306, at the front of the enclosure 302. Air inlets 310 are located on the top of the enclosure 302. A robot 316 moves along a lateral rail, to transfer wafers 250 from the load station 306 into or out of the processors 30 or spin rinse dryers 320.

An isolation wall 318 may be provided between the processors 30 and the robot 316, to reduce exposure of the robot 316 to process chemicals used in the processors 30. An opening is provided in the isolation wall 318, to allow an end effector of the robot 316 to reach into the processors 30. A wafer transfer zone or area 340 may be provided between the isolation wall 318 and the processors 30. When a wafer is moved between processors 30 and 320, the wafer may remain within the transfer zone 340 as the robot 316 carries the wafer parallel to the isolation wall 318. Any residual process liquids that may be on the wafer may therefore come into contact only with the end effector, but not with the rest of the robot 316. A controller 304 controls movement and operation of the robot 316, processors 30, spin rinse dryers 320, as well as various other components within the system 300 (e.g., pumps, valves, actuators, displays, interlocks, communications, etc.), as is well known in the semiconductor field. The deck 324, isolation wall 318, enclosure 302, and other components of the system 300 may advantageously be made of plastic materials, to better avoid contamination and corrosion.

Figure 36:
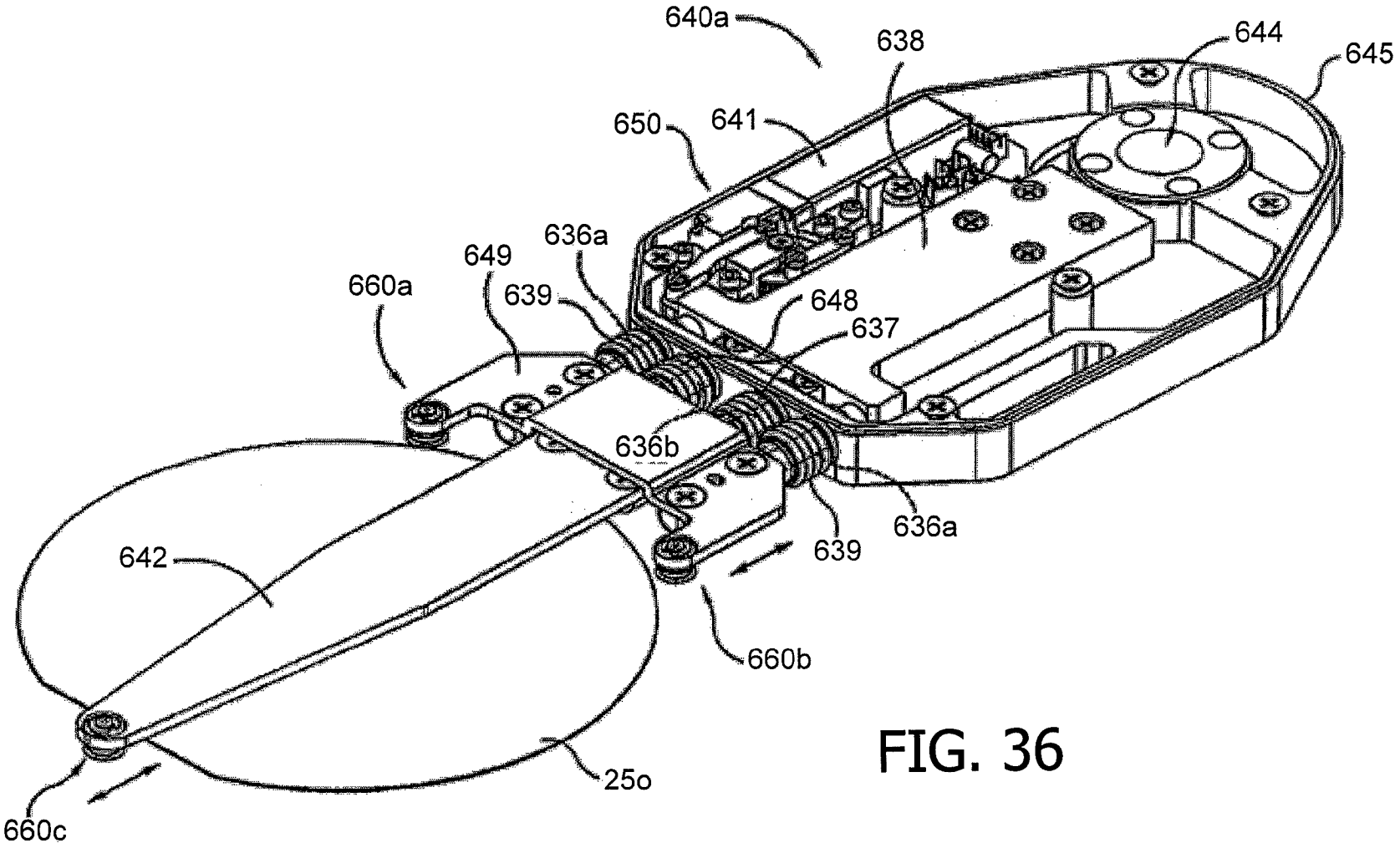
FIG. 36 is a perspective view of an end-effector for use in the system shown in FIGS. 33-35. The top cover is removed for purpose of illustration.

FIG. 36 is a perspective view of an end-effector 640*a* for use in the system shown in FIGS. 32-35. The end-effector 640*a* has a first gripper 660*a* and a second gripper 660*b*, both positioned opposite from a third gripper 660*c*. The first end-effector 640*a* is configured to reach over a workpiece and clamp its edges. The first end-effector 640*a* includes a yoke 649 carrying the first and second grippers 660*a-b*, and a blade 642 carrying the third gripper 660*c*. Both the yoke 649 and the blade 642 are actuated to move between a release position and a grip position. Accordingly, the yoke 649 is connected to a yoke carriage 638 via yoke drive rods 636*a*. The blade 642 is connected to a blade carriage 648 via blade drive rods 636*b*. The blade drive rods 636*b* are protected by blade seals 637, and the yoke drive rods 636*a* are protected by yoke seals 639. Accordingly, when the end-effector 640*a* is used in the system 300, which is a chemically harsh environment, the components within the housing 645 are protected from exposure to such chemicals. Components external to the housing 645 are formed from plastics and/or other materials selected for their resistance to the chemical environment. This arrangement is useful for processing porous silicon, which involved use of HF and/or other highly corrosive substances.

The blade carriage 648 is guided along a linear path by an internal linear guide and the yoke carriage 638 is guided along a parallel and overlying linear path by the blade carriage 648, which is slideably received in an aperture of the yoke carriage 638. The yoke carriage 638 and the blade carriage 648 are both connected to a motor 641 via a transmission 650. The motor 641 and the transmission 650 are configured to simultaneously move the blade 642 and the yoke 649 during actuation.

Figure 37:
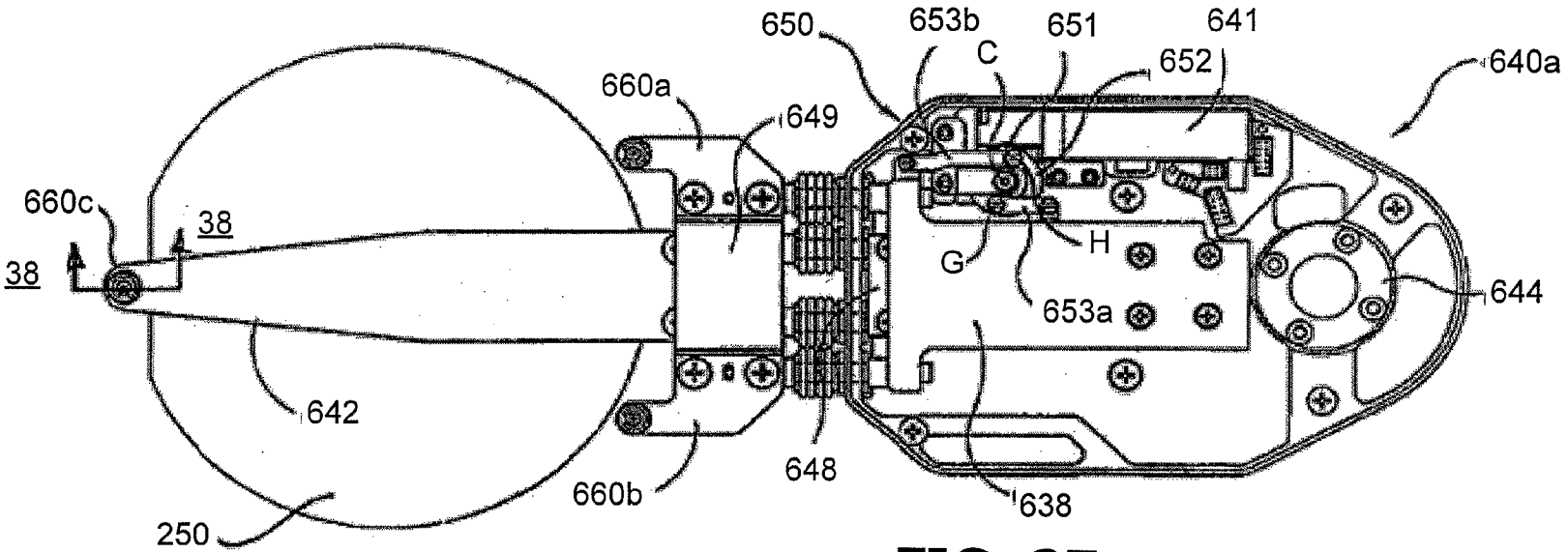
FIG. 37 is a top view of the end-effector shown in FIG. 36.

FIG. 37 is a top plan view of the end-effector 640*a*, shown in its release position. Accordingly, the grippers 660*a-c* are retracted away from the workpiece 250. The transmission 650 transmits the force put out by the motor 641 in a manner that increases the force applied by the grippers 660*a-c* as the grippers reach their grip positions. Accordingly, in the illustrated arrangement, the transmission 650 includes a worm 651 driven by the motor 6411 and a worm gear 652 engaged with the worm 651 and rotatable about a worm gear rotation axis C. The worm gear 652 is connected to two drive links 653, shown as a blade drive link 653*a* connected between the worm gear 652 and the blade carriage 648, and a yoke drive link 653*b* connected between the worm gear 652 and the yoke carriage 638. As the worm gear 652 rotates about the worm gear rotation axis C, the drive links 653*a-b* are driven in opposite directions to move the blade carriage 648 and the yoke carriage 638 toward or away from each other simultaneously. Accordingly, the first and second grippers 660*a-b* move simultaneously toward or away from the third gripper 660*c*.

As shown in FIG. 37, the drive links 653*a-b* are mounted eccentrically relative to the worm gear rotation axis C at pivot points G and H, respectively. Accordingly, the incremental forces applied by the drive links 653*a* are at a minimum when the blade pivot points G and H are at the 12:00 and 6:00 positions, respectively, and increase as the blade pivot points G, H are rotated from these positions. In the arrangement shown in FIG. 371 the blade drive link 653*a* rotates counterclockwise from the 6:00 position to its grip position, and the yoke drive link 653*b* rotates counterclockwise from the 12:00 position to its grip position. An advantage of increasing the incremental force applied by the grippers 660*a-c* as they approach the grip position is that the grippers more firmly engage the workpiece 250 and are therefore less likely to mishandle the workpiece 250.

An additional advantage of an arrangement shown in FIG. 37 is that both the blade 642 and the yoke 649 move simultaneously during the release and grip processes. This arrangement can increase the accuracy with which the workpiece is positioned, particularly when it is released.

Figure 38:
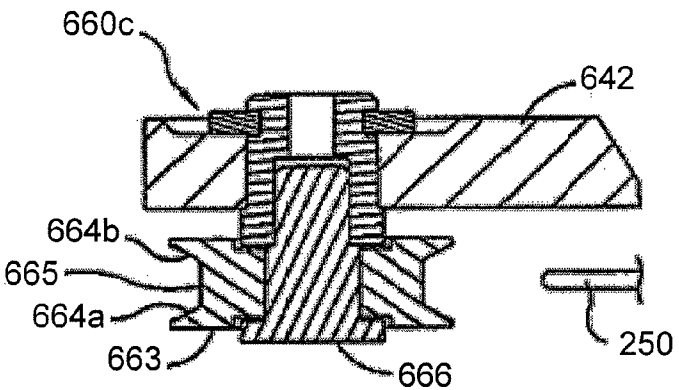
FIG. 38 is a section view taken along line 38-38 of FIG. 37.

FIG. 38 is a cross-sectional side view of the third gripper 660*c* and a portion of the workpiece 250. The third gripper 660*c* includes a roller 663 pivotally connected to the blade 642 with a roller pin 666. The roller 663 includes upper and lower beveled guide surfaces 664*a-b* and an intermediate contact surface 665. When the workpiece is engaged by the gripper 660*c*, it tends to bear directly against the contact surface 665, typically at or near the intersection between the contact surface 665 and the lower beveled guide surface 664*b*. If the gripper 660*c* were fixed, then during the release process (while the first and second grippers 660*a-b*, shown in FIG. 37 retract), the workpiece tends to slide along the lower beveled guide surface 664*b* when it becomes unsupported by the first and second grippers 660*a-b*. This effect may result in different workpieces 250 behaving in different, unpredictable manners during the release process. Accordingly, an aspect of the end-effector 640*a* is that the third gripper 660*c* moves simultaneously with the first and second grippers 660*a-b*. This reduces the likelihood that the workpiece 250 will remain engaged with one of the grippers (e.g., the third gripper 660*c*) during the release process, and may increase the precision with which the workpiece is positioned after release.

Returning briefly to FIG. 36, the end-effector 640*a* includes a hub assembly 644 that rotatably connects the end-effector 640*a* to the arm of the robot 316. The hub assembly 644, in addition to providing the rotational connection between the end-effector 640*a* and the arm 316, also provides the location at which electrical signals are communicated back and forth between the arm 316 and the end-effector 640*a*, despite the relative rotational movement of these two components.

In use, wafers 250 are delivered to the load station 306, typically within a cassette, box, or carrier 314. The load window 308 opens. The robot 316 picks up a wafer 250 at the load station 306 and moves the wafer 250 into one of the processors 30. The wafer may optionally be first moved into a pre-aligner 312, or other chamber for a pre-processing step. The wafer 250 is processed within the processor 30, as described above. In the interim, the robot 316 may return to the load station 306 to repeat the load sequence and load another wafer into the second processor 30. Upon completion of processing, each wafer 250 may be moved by the robot 316 into one of the spin rinse dryers 320. The spin rinse dryers 320 shown have lift/rotate apparatus 322 used to lift and rotate the head of the spin rinse dryer 322 into a load/unload position. Various types of spin rinse dryers (or other types of additional chambers or processors, e.g., metrology, anneal, etc.), with or without lift/rotate apparatus, may be equivalently used. After each wafer 250 is rinsed and dried, the robot 316 moves the wafer back to the load station 306, where the wafer is typically placed back into the same cassette 314, or into a different cassette.

The processor 30 itself may also perform rinsing and drying, as a stand alone unit or within a processing system. After an optional line purging step, rinsing may be performed by flowing a rinse liquid, such as de-ionized water, through the process chambers 146 and 240, typically with the wafer and the chamber in the vertical position. The rinse liquid may then be relatively slowly drained out, to perform a slow extraction type of drying process. In many applications, this process will leave the wafer sufficiently dry for subsequent handling or processing, even if some droplets of rinse liquid remain on the wafer. In an alternative drying process, a surface tension/meniscus drying step may be used after rinsing the wafer. In this alternative process, a drying fluid, such as isopropyl alcohol, can be provided into the process chambers during the drying step.

Referring to FIG. 34, the system 300 may optionally include an isolation chamber rinse system 190. If used, the rinse system 190 may include a rinse water channel or array of spray nozzles 192 aligned with and adjacent to the load slot frame 62 of the processor 30, when the processor is rotated into the vertical position. Similarly, an isolation drain collection pipe 194 may be provided in the system 300, adjacent to and aligned with the isolation drain 58, when the processor 30 is in the vertical position. Adequate clearance is provided between the processor 30 and the channel 192 and collection pipe 194, so that the processor 30 can freely pivot between the vertical and horizontal positions. The isolation drain 58 may optionally be connected to a drain/exhaust line, such as the collection pipe 194, via a flexible tube 334 shown in FIG. 14, which can accommodate the vertical to horizontal movement of the processor 30, to help insure that no liquid or vapors draining from the processor 30 are released into the system 300.

The isolation chamber which is generally shown at 60 in FIGS. 5, 6 and 14, may be rinsed by moving the processor 30 into the vertical position, and then providing rinse water from the overhead array of spray nozzles 192 through the load slot 56 into the processor 30. The rinse water drains out of the processor 30 through the isolation drain 58, and into the collection pipe 194. The collection pipe 194 connects to a system or facility drain. The isolation chamber rinse system 190 may be used to provide routine rinsing of the isolation chamber 60, during wafer processing, between wafer processing, or periodically, after processing a preselected number of wafers. The isolation chamber rinse system 190 may also be used if a fault condition is detected indicating a potential leak of electrolyte. In this condition, the isolation chamber 60 can be rapidly flooded with rinse water, to reduce any leakage of electrolyte (liquid or vapors) into the system 300. The processor may optionally be made and used without any isolation chamber 60. The processor 30 may also be used as a chemical process chamber, rather than as an electro-chemical processor, by not providing any current to the electrodes, or by omitting the electrodes entirely, e.g., by replacing the rings 106 and 204 with plates with a solid and continuous center section. In this design, the various chemical process liquids may be used, instead of electrolyte.

Although wafer loading/unloading with the wafer in a horizontal position is more commonly used in many types of existing wafer handling equipment, the processor 30, or the automated system 300, may also be adapted to operate with wafer loading/unloading in a vertical orientation. Terms used here, including in the claims, such as upper and lower, above and below, etc. are intended for explanation and not requirements that one element be above or below another element. Indeed, the processor 30 may be operated upside down. While porous silicon has been described above, the processor 30 may also be used for processing similar materials, including gallium compounds. The terms vertical and horizontal here include positions within 5, 10 or 15 degrees of vertical or horizontal, respectively. The processor 30 may also be used in a fixed position. For example, the processor 30 may be used without any rotate motor 38 and mounting plates 330. In this design, the processor 30 may be supported in a fixed horizontal position, or in a fixed vertical position, or at an angle between horizontal and vertical.

Various changes and substitutions may of course be made without departing from the spirit and scope of the invention. The invention, therefore, should not be limited, except by the following claims and their equivalents.

The invention claimed is:

1. A wafer processing system comprising:

a plurality of wafer processors, including at least one of the wafer processors including:

a housing;

a first seal in the housing;

a first electrode in the housing associated with the first seal;

a second seal in the housing moveable relative to the first seal;

a second electrode associated with the second seal and having a polarity opposite from the first electrode; and a motor linked to the housing for pivoting the housing;

with the first seal and first electrode forming a first process chamber with a first side of a wafer, and with the second seal and the second electrode forming a second process chamber with a second side of the wafer, when a wafer is placed between the first and second seals, and when the second seal is moved into contact with the wafer.

2. The processing system of claim 1 wherein the housing comprises a head attached to a base, and with the second electrode and the second seal in the head, and with the first seal and the first electrode in the base.

3. The processing system of claim 2 wherein the head is attached to the base via a retainer including a plurality of cam elements.

4. The processing system of claim 2 with the second seal and the second electrode forming a moveable electrode assembly, and further including an actuator in the head attached to the moveable electrode assembly.

5. The processing system of claim 4 with the actuator comprising a hydraulic cylinder.

6. The processing system of claim 1 further comprising a containment chamber in the housing and with the first and second seals and the first and second electrodes within the containment chamber.

7. The processing system of claim 6 with the containment chamber having an inlet on one side of the housing and an outlet spaced apart from the inlet.

8. The processing system of claim 6 with the housing including a base and a head including a head cover, and with the second seal and the second electrode forming a moveable electrode assembly in the head, and further comprising a bellows having a first end attached to the head cover and having a second end attached to the moveable electrode assembly.

9. The processing system of claim 1 with the housing including a base and a head, and with the second seal and the second electrode in the head and the first seal and the first electrode in the base, and further including a plurality of locating pins in the base around an outside perimeter of the first seal, with an upper section of substantially each of the locating pins within a bore in the head, for maintaining the head in alignment with the base.

10. The processing system of claim 1 further comprising first and second electrolyte inlets and outlets in the first and second chambers, respectively, and with a diffuser over at least one of the inlets or outlets.

11. The processing system of claim 1 further comprising at least one ejector tab on the first seal.

12. The processing system of claim 1 further comprising a containment chamber substantially enclosing the first process chamber and the second process chamber, with a loading opening and a drain/exhaust opening connecting into the containment chamber.

13. The processing system of claim 12 further comprising a motor linked to the containment chamber for pivoting the containment chamber into loading and processing positions.

14. A processing system comprising:

a plurality of processors, with at least one of the processors including:

a workpiece support;

a first process chamber on a first side of the support;

a second process chamber on a second side of the support, opposite to the first side;

process fluid supply means for supplying process fluid into the first and second process chambers;

seal means for sealing the first process chamber from the second process chamber;

electrical current means including at least one anode and at least one cathode for passing electrical current through a process fluid in the first process chamber, a workpiece, and process fluid in the second process chamber; and means for rotating the process chambers between a load position and a process position; and a robot moveable to access one or more of the processors.

15. The processor of claim 14 with the workpiece support comprising a seal.

16. A porous silicon wafer processing system comprising:

a plurality of processors, including at least one porous silicon processor including:

a housing;

a first seal in the housing;

a first electrode in the housing associated with the first seal;

a second seal in the housing moveable relative to the first seal;

a second electrode associated with the second seal; and a motor linked to the housing for pivoting the housing;

with the first seal and first electrode forming a first process chamber with a first side of a wafer, and with the second seal and the second electrode forming a second process chamber with a second side of the wafer, when a wafer is placed between the first and second seals, and when the second seal is moved into contact with the wafer; and a robot moveable to load and unload a workpiece into one or more of the processors.

17. A method comprising:

placing a wafer into a process chamber, with a first side of the wafer contacting a first seal, and with the wafer in a substantially horizontal orientation;

moving a second seal into contact with a second side of the wafer;

moving the wafer into a substantially non-horizontal orientation;

contacting the first and second sides of the wafer with an electrolyte; and passing electrical current through the electrolyte and the wafer.

18. The method of claim 17 further comprising aligning the wafer on the first seal by contacting an edge of the wafer with an aligning pin adjacent to the first seal.

19. The method of claim 17 further comprising moving the second seal away from the wafer after processing the wafer, while holding the wafer substantially in place on the first seal.

20. The method of claim 17 further comprising oscillating the processor.

21. The method of claim 17 further comprising providing a containment chamber around the process chamber and flowing a fluid through the containment chamber, with the fluid sealed out of the process chamber by the first and second seals.

22. A wafer processor system comprising:

a plurality of wafer processors, including at least one porous silicon wafer processor, including:

a housing;

a first seal in the housing;

a first electrode in the housing associated with the first seal, with the first electrode having a diameter to thickness ratio of about 4-10 to 1;

a second seal in the housing moveable relative to the first seal; and a second electrode associated with the second seal.

23. A processing system comprising:

a plurality of processors, with at least one of the processors including:

a housing;

a first seal in the housing;

a first electrode in the housing;

a second seal in the housing moveable relative to the first seal;

a second electrode, with the first and second electrodes having opposite polarity; and one or more lamps positioned to shine light'through an open central area of the first electrode, towards a workpiece between the first and second seals; and a robot moveable to access one or more of the processors.

24. The processing system of claim 23 comprising a motor linked to the housing of each processor.

25. The processing system of claim 23 wherein the housing of substantially each processor comprises a head attached to a base, and with the second electrode and the second seal in the head, and with the first seal and the first electrode attached to the base.

26. The processing system of claim 23 with the first electrode in substantially each processor having an annular shape.

27. The processor of claim 25 with the second seal and the second electrode forming a moveable electrode assembly, and further including an actuator in the head attached to the moveable electrode assembly, in substantially each processor.

28. The processing system of claim 27 further comprising a lens and a diffuser between the lamps and the first seal.

29. The processing system of claim 26 with the first electrode having an angled inside facing surface.

30. The processing system of claim 26 with the first electrode spaced apart from the first seal by a dimension less than the diameter of the first electrode.

31. A porous silicon processing system comprising:

a plurality of processors, with at least one of the processors including:

a process chamber having a first seal spaced apart from a first electrode, and a second seal spaced apart from a second electrode, and with the second seal and the second electrode on a moveable electrode assembly;

a containment chamber substantially enclosing the process chamber, with a loading opening and a drain/exhaust opening connecting into the containment chamber; and a light source positioned to project light onto a wafer supported on the first seal.

32. The processing system of claim 31 further comprising a motor linked to the containment chamber for pivoting the containment chamber, and the process chamber in the containment chamber, into loading and processing positions.

33. The processing system of claim 31 with the first electrode spaced apart from the first seal by a dimension 150%-400% greater than the spacing between the second electrode and the second seal, in at least one of the processors.

34. Apparatus, comprising:

a plurality of processors, including at least one porous silicon processor including:

a head having a moveable electrode assembly including a head electrode and a head seal substantially concentric with the head electrode, with the head seal spaced apart from the head electrode, and with the head seal and the head electrode forming a head process chamber with a second side of a wafer;

a head fluid inlet and a head fluid outlet in the electrode assembly connecting into the head process chamber;

a base having a base seal;

a base electrode supported on the base and substantially concentric with the base seal;

a window on the base, with the base, the base seal, the base electrode, and the window forming a base process chamber with a first side of the wafer;

a base fluid inlet and a base fluid outlet in the base; and a light source projecting light through the window onto the first side of the wafer; and a robot moveable to load and unload a wafer into and out of the porous silicon processor.

35. The apparatus of claim 34 with the base electrode having an open central area and with the light source projecting light through the open central area of the base electrode.

36. A processing system comprising:

one or more processors, with at least one of the processors being a porous silicon processor, including:

a workpiece support;

a first process chamber on a first side of the support;

a second process chamber on a second side of the support, opposite to the first side;

process fluid supply means for supplying process fluid into the first and second process chambers;

seal means for sealing the first process chamber from the second process chamber;

electrical current means for passing electrical current through a process fluid in the first process chamber, a workpiece, and process fluid in the second process chamber; and lighting means for illuminating the workpiece; and a robot moveable to load a wafer into the porous silicon processor.

37. The processing system of claim 36 further comprising means for rotating the process chambers between a load position and a process position.

38. The processing system of claim 36 with the workpiece support comprising a seal.

39. A processing system comprising:

two or more processors, each including:

a housing;

a first seal in the housing;

a first electrode in the housing;

a second seal in the housing moveable relative to the first seal;

a second electrode moveable with the second seal, with the first and second electrodes having opposite polarity;

a light source for illuminating a workpiece held between the first and second seals; and a motor linked to the housing for pivoting the housing;

a robot moveable to load and unload workpieces into the processors.

40. A method comprising:

placing a wafer into a process chamber, with a first side of the wafer contacting a first seal, and with the wafer in a substantially horizontal orientation;

moving a second seal into contact with a second side of the wafer;

moving the wafer into a substantially non-horizontal orientation;

contacting the first and second sides of the wafer with an electrolyte;

passing electrical current through the electrolyte and the wafer; and illuminating the first side of the wafer.

41. The method of claim 40 further comprising aligning the wafer on the first seal by contacting an edge of the wafer with an aligning pin adjacent to the first seal.

42. The method of claim 40 further comprising moving the second seal away from the wafer after processing the wafer, while holding the wafer substantially in place on the first seal.

43. The method of claim 40 further comprising oscillating the processor.

44. The method of claim 40 further comprising providing a containment chamber around the process chamber and flowing a fluid through the containment chamber, with the fluid sealed out of the process chamber by the first and second seals.

45. A processing system comprising:

a plurality of processors, with at least one of the processors including:

a first seal;

a first electrode having a first open central area;

a second seal moveable relative to the first seal;

a second electrode having second open central area, with the first and second electrodes having opposite polarity;

one or more first lamps positioned to shine light through the first open central area of the first electrode towards the first seal; and one or more second lamps positioned to shine light through the second open central area of the second electrode towards the second seal.

46. A processing system comprising:

a plurality of processors, with at least one of the processors including:

a first electrode;

a first seal element adapted to seal against a first surface of a workpiece, with the first seal element between the first electrode and the first side of the workpiece;

a second electrode having a polarity opposite of the first electrode;

a second seal element adapted to seal against a second surface of a workpiece, with the second seal element between the second electrode and the workpiece, and with the second seal element moveable relative to the first seal element; and one or more lamps positioned to shine light through an open central area of the first electrode, towards the first seal.

47. A method comprising:

placing a wafer into a process chamber, with a first side of the wafer contacting a first seal, moving a second seal into contact with a second side of the wafer;

contacting the first and second sides of the wafer with an electrolyte;

passing electrical current through the electrolyte; and illuminating the first and second sides of the wafer.

* * * * *